US011410842B2

(12) United States Patent
Rusinov et al.

(10) Patent No.: US 11,410,842 B2
(45) Date of Patent: Aug. 9, 2022

(54) TIME-FREQUENCY ANALYSIS

(71) Applicant: SHIMADZU CORPORATION, Kyoto (JP)

(72) Inventors: Aleksandr Rusinov, Manchester (GB); Li Ding, Manchester (GB)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/308,657

(22) Filed: May 5, 2021

(65) Prior Publication Data

US 2021/0375607 A1 Dec. 2, 2021

(30) Foreign Application Priority Data

May 27, 2020 (GB) ..... 2007937

(51) Int. Cl.
*H01J 49/00* (2006.01)
*H01J 49/02* (2006.01)
*H01J 49/42* (2006.01)

(52) U.S. Cl.
CPC ..... *H01J 49/027* (2013.01); *H01J 49/0031* (2013.01); *H01J 49/0036* (2013.01); *H01J 49/4225* (2013.01)

(58) Field of Classification Search
CPC .. H01J 49/027; H01J 49/0031; H01J 49/0036; H01J 49/4225

(Continued)

(56) References Cited

U.S. PATENT DOCUMENTS 7,964,842 B2 6/2011 Koster et al.
2009/0294651 A1* 12/2009 Koster ..... H01J 49/38 250/252.1

FOREIGN PATENT DOCUMENTS

EP 2 642 508 A2 9/2013
EP 2 681 759 A1 1/2014

(Continued)

OTHER PUBLICATIONS

Jared O. Kafader, et al., "STORI Plots Enable Accurate Tracking of Individual Ion Signals", J. Am. Soc. Mass Spectrom, 2019, pp. 2200-2203.

(Continued)

*Primary Examiner* — Michael Maskell
(74) *Attorney, Agent, or Firm* — Sughrue Mion, PLLC

(57) ABSTRACT

Apparatus and method for processing an image-charge/current signal for an ion(s) undergoing oscillatory motion within an ion analyser apparatus. The method comprises: obtaining a recording of the image-charge/current signal (20*a*-20*e*) in the time domain. Then, by a signal processing unit, a value for the period (T) of a periodic signal component is determined within the recorded signal. Subsequently, the recorded signal is segmented into a number of successive time segments [0;T] of duration corresponding to the period (T). These lime segments are then co-registered in a first time dimension ($t_1$) defining the period (T). The co-registered time segments are then separated along a second time dimension ($t_2$) transverse to the first time dimension ($t_1$). This generates a stack of time segments collectively defining a 2-dimensional (2D) function. The 2D function varies both across the stack in the first time dimension and along the stack in the second time dimension.

23 Claims, 11 Drawing Sheets

(58) Field of Classification Search
USPC ..... 250/281, 282
See application file for complete search history.

(56) References Cited

FOREIGN PATENT DOCUMENTS

| | | | |
|---|---|---|---|
| EP | 2 779 206 | A2 | 9/2014 |
| WO | 02/103747 | A1 | 12/2002 |
| WO | 2012/116765 | A1 | 9/2012 |
| WO | 2016/083074 | A1 | 6/2016 |
| WO | 2017/162779 | A1 | 9/2017 |

OTHER PUBLICATIONS

D. Zajfman, et al., "Self-bunching effect in an ion trap resonator", J. Opt. Soc. Am. B, May 2003, pp. 1028-1032, vol. 20, No. 5.
David Z. Keifer, et al., "Charge detection mass spectrometry: weighing heavier things", Analyst, 2017, pp. 1654-1671, vol. 142.
Leon Cohen, "Time-Frequency Distributions—A Review", Proceedings of the IEEE, Jul. 1989, pp. 941-981, vol. 77, No. 7.
Li Ding, et al., "High-Capacity Electrostatic Ion Trap with Mass Resolving Power Boosted by High-Order Harmonics", Analytical Chemistry, 2019, pp. 7595-7602, vol. 91, No. 12.
Li Ding, et al., "A Simulation Study of the Planar Electrostatic Ion Trap Mass Analyzer", Journal of The American Society for Mass Spectrometry, 2013, pp. 356-364, vol. 24, No. 3.
Geoffrey Spence, et al., "A Time-Domain Analysis of Multiple Periodic Signals", Proceedings of the International Symposium Time-Frequency and Time-Scale Analysis, Feb. 8, 2021, pp. 1-10.
United Kingdom Search Report for GB2007937.2 dated Feb. 17, 2021.

* cited by examiner

TIME-FREQUENCY ANALYSIS

FIELD OF THE INVENTION

The present invention relates to methods and apparatus for image-charge/current analysis and an ion analyser apparatus therefor, and particularly, although not exclusively, to analysis of image-charge/current signals generated by an ion mobility analyser, a charge detection mass spectrometer (CDMS) or an ion trap apparatus such as: an ion cyclotron, an Orbitrap®, an electrostatic linear ion trap (ELIT), a quadrupole ion trap, an Orbital Frequency Analyser (OFA), a Planar Electrostatic Ion Trap (PEIT), or other ion analyser apparatus for generating oscillatory motion therein.

BACKGROUND in general, an ion trap mass spectrometer works by trapping ions such that the trapped ions undergo oscillatory motion, e.g. backwards and forwards along a linear path or in looped orbits. An ion trap mass spectrometer may produce a magnetic field, an electrodynamic field or an electrostatic field, or a combination of such fields to trap ions. If ions are trapped using an electrostatic field, the ion trap mass spectrometer is commonly referred to as an "electrostatic" ion trap mass spectrometer.

In general, the frequency of oscillation of trapped ions in an ion trap mass spectrometer is dependent on the mass-to-charge (m/z) ratio of the ions, since ions with large m/z ratios generally take longer to perform an oscillation compared with ions with small m/z ratios. Using an image-charge/current detector, it is possible to obtain, non-destructively, an image charge/current signal representative of trapped ions undergoing oscillatory motion in the time domain. This image-charge/current signal can be converted to the frequency domain e.g. using a Fourier transform ("FT"). Since the frequency of oscillation of trapped ions is dependent on m/z, an image-charge/current signal in the frequency domain can be viewed as mass spectrum data providing information regarding the m/z distribution of the ions that have been trapped.

In mass spectrometry, one or more ions undergoing oscillatory motion within an ion analyser apparatus (e.g. an ion trap) may induce an image-charge/current signal detectable by sensor electrodes of the apparatus configured for this purpose. A well-established method for analysing such an image-charge/current signal is to perform a transformation of that time-domain signal into the frequency domain. The most popular transformation for this purpose is the Fourier transformation (FT). Fourier transformations decompose a time-domain signal into sinusoidal components, each component having a specific frequency (or period), amplitude and phase. These parameters are related to the frequency (or period), amplitude and phase of periodic components (frequency components) present in the measured an image-charge/current signal. The frequency (or period) of those periodic components can be easily related to the m/z value of the respective ion species or to its mass if its charge state is known. Mass spectrometers utilizing these principles are called Fourier Transform Mass Spectrometers, and the field itself is called Fourier Transform Mass Spectrometry (FTMS).

Two popular FTMS ion traps are the Fourier Transform Ion Cyclotron Resonance trap (FTICR) and the Orbitrap®. The former uses magnetic fields to trap ions, while the latter uses electrostatic fields to trap ions. Both traps generate harmonic image-charge/current signals. Other types of FTMS ion traps are configured to generate non-harmonic image-charge/current signals. FTICR typically employs a superconductor magnetic field for ion trapping, whereas in an "Orbitrap®", ions are trapped by an electrostatic field so as to cycle around a central electrode in spiral trajectories. Another known example of ion trap mass spectrometer is the Orbital Frequency Analyser (OFA) described in: "*High-Capacity Electrostatic Ion Trap with Mass Resolving Power Boosted by High-Order Harmonics*": by Li Ding and Aleksandr Rusinov. *Anal. Chem.* 2019, 91, 12, 7595-7602. Yet another known example of ion trap mass spectrometer is the Electrostatic Ion Beam Trap ("EIBT") disclosed in WO02/103747 (A1), by Zajfman et al. In an EIBT, ions generally oscillate backwards and forwards along a linear path, so such an ion trap is also referred to as an "Electrostatic Linear Ion Trap" (ELIT).

Analysis of non-harmonic image-charge/current signals also can be performed using the Fourier transformation, and doing so will generate multiple harmonics for each periodic/frequency component of the image-charge/current signal. However, harmonics of different orders can mix (overlap) with each other within the frequency spectrum of the Fourier transformed image-charge/current signal, and this makes it much more difficult to relate frequency of components to mass-to-charge (m/z) or mass of ion species.

Several methods have been proposed to address this issue, but in many such methods the signal analysis merely aims to determine a single frequency value which corresponds to an m/z of an ion species. However, it does not give any highlights on the dynamics of the periodic/frequency component over time. There are several techniques in the art that aim to look into such dynamics, and these techniques typically apply so-called "time-frequency analysis" to image-charge/current signals containing transients. Short Time Fourier Transforms (STFT) are an example of this, as described in U.S. Pat. No. 7,964,842B2 (Claus Köster et al.), "EVALUATION OF FREQUENCY MASS SPECTRA". This technique, like so many "time-frequency analysis" techniques, relies on generating a two-dimensional function, F(t,f), from an image-charge/current signal in which one dimension of the function is a time dimension (t) and represents a time variation of the signal, whereas a second dimension of the function is a frequency dimension (f) and represents a frequency spectrum of the signal. FIG. 1A schematically represents the form of this type of 2D function in "time-frequency analysis", and FIG. 1B graphically shows an example of such a function. The technique relies on analysis of the 2D function, F(t,f), in both the time domain and the frequency domain to derive frequency variations in the signal over time. Such an approach requires the considerable computational cost and complexity of multiple calculations of Fourier Transform integrals over time in order to generate each frequency node of the 2D function, F(t,f).

The present invention has been devised in light of the above considerations.

SUMMARY OF THE INVENTION

Image-charge/current signals may be acquired in mass spectrometers which use non-destructive detection of signals containing periodic components corresponding to oscillations of certain trapped ion species. However, the invention is applicable to any other field ion analysis where signals containing periodic components need to be analysed. The frequency of ion motion depends on its mass-to-charge (m/z) ratio, and where multiple packets of ions exist within an ion analyser (e.g. ion trap), the motion of each packet of ions with the same m/z ratio may be synchronous as provided by the focusing properties of an ion analyser.

The invention relates to analysis of signals called transients within image-charge/current signals. A signal may contain one or more periodic components. Periodicity of a component implies that it reveals changes in magnitude or amplitude of the signal occurring once with a certain period of time, and repeating once each successive such period of time. Each periodic component is also called a frequency component of the signal. The total signal is the sum of all periodic/frequency components. The period, T (seconds), of a periodic component can be said to correspond to a frequency, f (Hz), of the corresponding frequency component via the relation: f=1/T. Herein, we refer to "periodic component" and "frequency component" interchangeably in this sense. An image-charge/current signal may be non-harmonic or harmonic in nature, and both instances may comprise periodic components within them. For example, the image charge/current signal may result from ion motion that is "simple harmonic motion", such that the image charge/current signal may be sinusoidal in form. However, the invention is not limited to such signals and such ion motion. Accordingly, an image charge/current signal may result from other types of harmonic motion of ions, which is not "simple harmonic motion" but is a repeating periodical motion. The invention is particularly, although not exclusively, relevant to ion traps where ion motion is periodic or nearly periodic and is detected by pick-up (image-charge/current) detectors.

At its most general, the invention provides methods and apparatus for creating, from a one-dimensional (1D) image-charge/current signal, a two-dimensional (2D) function showing the image charge/current signal which extends across two transverse dimensions of time in which the two time dimensions are configured to allow direct and easy identification of periodic components (i.e. frequency components) in oscillatory motion within an ion analyser apparatus and of changes in such motion. This avoids the need to resort to generating 2D time-frequency distributions requiring the use of Fourier transforms, or the like. Another advantage of the present invention is that it gives better mass resolution and better signal-to-noise (S/N) ratio than, for instance, STFT methods.

A 1D signal, $F_1(t)$, in a 1D time domain bearing one or more periodic components or frequency components, may be transformed into a 2D function, $F_2(t_1,t_2)$, in a 2D time domain by means of stacking successive segments of the signal after it has been segmented according a period corresponding to the frequency of one of the frequency components. Analysis of the shape of $F_2(t_1,t_2)$ allows one to determine and analyse frequency component behaviour. This provides useful information on the dynamics of ion motion and ion analyser performance. This information on ion motion is derived from a 2D time domain signal rather than from a frequency domain signal.

Segmentation of the 1D signal may be performed at a certain pre-selected period T, corresponding to a pre-selected frequency, f (where T=1/f). Each $n^{th}$ segment (n=1, 2, 3 . . . ) contains signal data restricted to the time interval [(n−1)T:nT] along a first time dimension, i.e. being a time within the $n^{th}$ occurrence of the pre-selected period T. Successive segments of the signal are put 'behind' the previous segment such that each segment extends, in a first time dimension, along a common interval, e.g. [0:T], whereas successive segments are arrayed along a second time dimension, one 'behind' another. This generates a 2D function from 1D signal data.

When the 1D time-domain signal $F_1(t)$ is produced, by recording many image-charge/current measurements sequentially over time, the result is a succession of data values. Each one of these data values represents the value of a particular image-charge/current measurement taken at a particular point in time. Of course, this means that each data value has its own unique 'time' value, this being the time at which that particular data point was recorded. In other words, the 1D time-domain signal $F_1(t)$ is a 1D function in which the 'independent variable' is time (t) and the 'dependent variable' is the value of an image-charge/current measurement taken at a given point in time. If the signal $F_1(t)$ contains a periodic component, then this will present itself periodically as a repeating feature within the succession of data values defined by $F_1(t)$. For example, that repeating feature might be a relatively brief, but significant, enhancement, or 'peak' or 'pulse' shape, in the value of $F_1(t)$ that is significantly different relative to the surrounding values of $F_1(t)$, which may be relatively uniform, such as background noise for example.

According to preferred aspects of the invention, a 'stacking' of successive segments of the signal $F_1(t)$ is performed, after that signal has been segmented onto equal segments of duration [0;T]. This has the effect of grouping multiple measurements together in the same one interval [0;T]. FIGS. 12(*a*), 12(*b*) and 12(*c*) show a schematic example of the effects of segmenting a signal $F_1(t)$, and stacking it, which is useful for a better understanding of the invention. In FIG. 12(*a*), there is shown a hypothetical 1D time-domain signal $F_1(t)$ in the form of a continuous curve displaying a periodic component which appears as a smooth signal peak, or pulse, feature which repeats within the signal periodically. The period of repetition of the pulse feature is 'T' seconds. In this example T is 8 units of time long (e.g. measured in milliseconds). The hypothetical 1D time-domain signal $F_1(t)$ is hypothetical in the sense that it is the signal one would see if one were to make a very large number of discrete measurements at very closely-spaced sampling time points over the time interval 3T, such that the measured signal appears practically continuous.

However, in practice, discrete measurements of such a signal are often made at sampling time points that are spaced by a more significant time step size (e.g. δt, in this example). FIG. 12(*a*) represents these discrete values of the 1D time-domain signal $F_1(t)$ as 'dots' upon the continuous curve of the hypothetical 1D function. The samples (dots) are each located at a respective one of 16 separate sampling time points (a, b, c, d, e . . . n, o, p) which are each separated in time, from their nearest-neighbour, by a sampling time interval δt. In this example, T=8 units of time in length, and δt=3/2 units of time in length. The 16 sampling time intervals span three periods (i.e. 3T=16δt=24 units). As can be seen in FIG. 12(*b*), if the stacking time interval [0;T'] is correctly chosen so that T'=T, then the effect of the stacking is to cause the different sampled data points to 'line-up' appropriately within the interval such that each is positioned within the interval [0;T'] at a location corresponding to its position within the time period, T, within which it was measured. In other words, the time position of a sample relative to the shape and location of the periodic peak feature, is preserved/reproduced within the stacking interval [0;T'] only of T'=T. Put another way, if T'=T then the periodic peak structure in any one of the stacking interval [0;T'] is made to be 'in phase', within the time interval [0;T'], with the 'phase' of the periodic peak structures in each of the other stacking intervals.

Accordingly, each sample data point shown in the stacked 1D time-domain signal $F_1(t)$ of FIG. 12(*b*), is labelled with the sample time point at which it was measured (i.e. 'm'; 'c'; 'h', etc.) and the samples can be seen to collectively trace/reproduce the shape of the periodic peak feature and its location within the period interval T. It is to be understood that in the example shown in FIG. 12(*a*), the sampling time interval δt is deliberately made large to help illustrate the constructive effect of appropriate segmentation and stacking. However, in practice, the sampling time interval δt may be much smaller than the duration of the periodic feature/peak such that the feature is already well-resolved within the un-segmented 1D time-domain signal $F_1(t)$. However, if the feature is of a relatively brief duration, then the detailed structure or shape of this signal feature might not be clear within $F_1(t)$ if the time interval between successive image-charge/current measurements is comparable to the time-duration of the signal feature, in other words, if insufficient sample measurements are made, during each occurrence of the feature, to resolve the feature clearly, then this problem may be overcome by the invention because the process of 'stacking' increases the density of data points within the interval [0;T'] and this may result in an increase in resolution of the feature, as seen in FIG. 12(*b*).

To illustrate this point further, FIG. 12(*c*) shows the result when the stacking time interval [0;T'] is incorrectly chosen so that T'≠T. In this example, T'=0.75T. The effect of the stacking is to cause the different sampled data points to spread out across the interval [0;T'] and to fall to 'line-up' appropriately. The samples can be seen to strikingly fail to collectively trace/reproduce both the shape of the periodic peak feature and its location within the period interval T'. Furthermore, the failure to trace/reproduce the shape and location of the periodic peak feature simply results in an unstructured scattering of data points across the space of the stacked signal. This scatter increasingly fills that space as the sampling time interval δt is reduced in size and the number of samples increases.

In this way, according to preferred aspects of the invention, the 'stacking' of successive segments of the signal $F_1(t)$ using a 'correct' stacking period, T'=T, causes a resolved transient or peak feature (cf. FIG. 12(*b*)) to appear from within an otherwise unstructured scattering of data (cf. FIG. 12(*c*), which would occur when T'≠T). By iterative searching/optimisation of a pre-selected stacking period, T', a match may be found to the period, T, of a periodic component (i.e. f=1/T matches the frequency of a frequency component) contained within the signal $F_1(t)$. By a process of detecting a change in the density of data in an area of the stacked 1D signal $F_1(t)$, one may detect when that data resolves into a peak-like shape representing the resolved transient or peak feature in the image-charge/current signal caused by oscillatory ion motion having a frequency component of frequency f=t/T.

This condition also presents itself within the 2D function, $F_2(t_1,t_2)$, in the 2D time domain as an array of successive aligned peaks which extends along a linear path parallel to the second time dimension, $t_2$. This is because, the time position of each appearance of the peak is the same position within successive stacked segments [0;T]. When those successive stacked segments are arrayed along the second time dimension, one 'behind' another, this draws the aligned peaks out along the second dimension in a linear array. The oscillatory motion of positively-charged ions may have the effect of periodically lowering the electrical potential on the pick-up electrode of an apparatus, thereby causing an image-charge/current signal to fall periodically. On the other hand, negatively-charged ions may cause a periodic increase of the electrical potential, thereby causing an image-charge/current signal to rise periodically. Furthermore, the 'sign' of an image-charge/current signal may be reversed by the electronics of the apparatus itself, thereby giving the user the option of choosing how the periodic component is presented (i.e. 'additively' or 'subtractively'). For the avoidance of doubt, references herein to "peak" or "peaks" in relation to image-charge/current signals includes a reference to either an enhancement (i.e. additive structure or pulse) or a drop/fall (i.e. subtractive structure or pulse).

The identification of a 'correct' stacking period may be done by detecting or identifying when a continuous sub-interval of time appears within the interval [0;T'], where there is an absence of any signal data points (or at least an insignificant number of them, such as fewer than 5%, or 2% or 1% of them) which have a signal value below an appropriate threshold value, or alternatively which have a signal value above an appropriate threshold value. In other words, in cases where the periodic component structure, within a signal, presents itself as an increase over the background signal (i.e. an additive structure or pulse) then the "appropriate threshold" may be set such that an absence/insignificance of signal data points that have a signal value below that threshold value may be monitored. Conversely, in cases where the periodic component structure, within a signal, presents itself as a decrease over the background signal (i.e. a subtractive structure or pulse) then the "appropriate threshold" may be set such that an absence/insignificance of signal data points that have a signal value above that threshold value may be monitored.

Alternatively, the identification of a 'correct' stacking period may be done by detecting or identifying when a continuous sub-interval of time appears within the interval [0;T'], where there is an absence of any signal data points (or at least an insignificant number of them, such as fewer than 5%, or 2% or 1% of them) which have a signal value not within an appropriate range of values wherein the upper limit of the range is bounded by an upper threshold value and the lower limit of the range is bounded by a lower threshold value, which is less than the upper threshold value. The magnitude of the upper threshold value may be selected to exceed the average value of the background signal (e.g. noise) within the interval [0;T']. The magnitude of the lower threshold value may be selected to be less than the average value of the background signal (e.g. noise) within the interval [0;T'].

The continuous sub-interval of time is most preferably selected to be greater in duration that the data sampling time interval. This sub-interval would appear if signal values persistently stay above, or below as appropriate, the threshold value over a continuous and significant sub-interval of time simultaneously within all of the stacked segments. This would indicate the presence of a periodic component there. In other words, the presence of the periodic component enhances/boosts, or diminishes/suppresses as appropriate, the measured signal value to be persistently above, or below as appropriate, the threshold value during the sub-interval.

The threshold level may be chosen to a value corresponding to the general background signal level (e.g. a noise level), or a level greater in value, or lower in value as appropriate. Preferably, the threshold level is greater than (or lower than, as appropriate) the general background level (e.g. an average noise level) but only modestly so. This is because if the threshold level is set too high (or too low, as appropriate), then it may overlook (i.e. be greater than, or less than) the peak signal (or dip signal) values associated with periodic components that have only modest amplitudes within the stacked signal.

In general, the presence of such a significant sub-interval may occur because all of the signal values within that sub-interval comprise two signal components:

(1) background noise; and, (2) a part of the resolved periodic feature.

An example of this is schematically shown in FIG. 12(*b*) in which the periodic component is presented 'additively' as an enhancement in signal level, and in which the continuous sub-region extending from T'/3 to 2T'/3 contains data points corresponding to sampling times 'g', 'b', 'm', 'h', 'c', 'n' and 'i'. All of these data points have signal values significantly raised above the general background signal level of the stacked signal. Conversely, the absence of any significant continuous sub-interval of this type, is illustrated in FIG. 12(*c*) for which data points corresponding to sampling times 'e', 'a', 'f', 'j', 'k', and 'l' each have a signal value corresponding to the general background signal level, and they are spread evenly along the whole length of the segment interval [0;T'].

The duration of the continuous sub-interval may be chosen to be at least 5% of the length of the segment interval [0;T'], or may be at least 10% of the length of the segment interval [0;T'], or may be at least 15% of the length of the segment interval [0;T'], or may be at least 20% of the length of the segment interval [0;T'], or may be at least 25% of the length of the segment interval [0;T'], or may be at least 30% of the length of the segment interval [0;T'], or may be at least 50% of the length of the segment interval [0;T']. The appropriate size of the continuous sub-interval may be chosen appropriately according to the likely/expected time-duration, or width, of a periodic transient feature (e.g. peak or pulse) to be detected. For example, narrower, or shorter, expected transient features may require the use of a shorter continuous sub-interval to more accurately detect them.

The continuous sub-interval of time may most preferably be greater in duration than the data sampling time interval, δt. For example, length/duration of the continuous sub-interval may be chosen to be at least twice the length of the sampling time interval, or may be at least 3 times the length of the sampling time interval, or may be at least five times the length of the sampling time interval, or may be at least 10 times, or 25 times, or 50 times, or 100 times the length of the sampling time interval.

Algorithms may automatically detect or identify when, and where, there is an absence of any signal data points (or at least an insignificant number of them) having signal values below a pre-set threshold level. For example, an algorithm may implement a method whereby the signal value of all samples within a pre-set sub-interval having a pre-defined duration, are compared to a pre-defined threshold as the location of the sub-interval is progressively moved along the interval [0;T'] as a 'sliding window', The 'sliding window' may be moved along the interval [0;T'] in successive steps of size equal to the data sampling time interval, δt, or a multiple of that interval. When the 'sliding window' does not contain any part of the periodic component, then the number of below-threshold data points within the 'sliding window', will be maximal. However, when the 'sliding window' contains only data points corresponding to the periodic component, then the number of below-threshold data points within the 'sliding window', will be zero. This latter condition may be used to detect the presence of a periodic component having a width not greater than the width of the 'sliding window'. Of course the width of the sub-interval defining the 'sliding window' may be reduced in order to try to detect periodic components that are narrower (e.g. narrower signal peaks). Preferably, the width of the 'sliding window' is less than the width/duration of the periodic component to be detected.

As mentioned previously, successive segments of the signal are put 'behind' the previous segment such that each segment extends, in a first time dimension, along a common interval, e.g. [0:T], whereas successive segments are arrayed along a second time dimension, one 'behind' another. This generates a 2D function from 1D signal data.

When the stacking period, T', coincides with the period, T, of a periodic component, then each one of the successive peaks within the array resides within a respective one of the successive segments and each is located (e.g. centred) at substantially the same location within the common interval, e.g. [0:T]. As a result, the linear path of the array of peaks extends along the second time dimension but does not extend along the first time dimension. For example, the path may be parallel to the axis of the second time dimension but orthogonal to the axis of the first time dimension.

If the path deviates from this condition, this indicates period variation of the oscillatory ion motion during the measurement of the image-charge/current. If the period (T) and, therefore, the frequency (f=1/T) of the frequency component, is not constant during the measurement of the image-charge/current, one will see a deviation of the path from the aforementioned linearity. This deviation has much analytical value.

The method is especially effective for non-harmonic image-charge/current signals containing "narrow" signal peaks, i.e. being "narrow" when the pulse width is much less than period, T, of the oscillatory ion motion. However, the method can be used for harmonic signals as well. The method allows one to obtain information, for example, on:

1. Frequency/periodic components: For example, isotopic ion species can be elucidated using acquisition times which would otherwise require analysis of substantially high order harmonics when using Fourier Transform methods. High order harmonic amplitudes reduce with increasing harmonic order, and this significantly deteriorates sensitivity when using Fourier Transform methods.
2. Dynamics of ion cloud behaviour: For example, it is possible to infer space-charge effects taking place during ion cloud oscillatory motion. This is useful for the tuning of ion trapping fields to reduce undesirable space-charge influences on ion clouds with different numbers of ions.
3. Period variation within a measurement time: This information may be used to correct the time axis of a time-domain signal. This is especially useful for analysis when a peak shape in frequency spectrum is ruined by instabilities of an ion trapping field occurring at the beginning of a measurement (NB, typically the strongest detection signal time) caused by the opening/closing of a gate. After the measurement time axis (e.g. the within each interval [0;T] along the first time dimension, $t_1$, of the 2D function) is corrected, the shape of peak in the frequency spectrum can be restored and can be used in further analysis.
4. Single ion events analysis. The method allows one to detect single ion events, and to determine ion fragmentation events taking place such as e.g. when a single ion collides with a residual gas atom or molecule. This is useful for constructing mass spectra of multiply charged heavy molecules and their fragmentation paths.

In a first aspect, the invention provides a method of processing an image-charge/current signal representative of one or more ions undergoing oscillatory motion within an ion analyser apparatus, the method comprising:

obtaining a recording of the image-charge/current signal generated by the ion analyser apparatus in the time domain;

by a signal processing unit:

determining (e.g. estimating, measuring or calculating) a value for the period of a periodic signal component within the recorded signal;

segmenting the recorded signal into a number of separate successive time segments of duration corresponding to the determined period;

co-registering the separate time segments in a first time dimension defining the determined period (i.e. by said step of 'determining', e.g. the above-mentioned period that may have been determined by estimation, measurement or calculation); and, separating the co-registered time segments along a second time dimension transverse to the first time dimension thereby to generate a stack of time segments collectively defining a 2-dimensional (2D) function which varies both across the stack in said first time dimension according to time within the determined period and along the stack in said second time dimension according to time between successive said time segments.

For example, the step of segmenting the recorded signal into a number of separate time segments may include converting the 1D function, $F_1(t)$, into the 2D function, $F_2(t_1, t_2)$, according to the relation:

$$t \rightarrow t_1 + t_2$$

$$F_1(t) \rightarrow F_2(t_1, t_2) \sim F_1(t_1 + t_2).$$

Here the variable $t_1$ is a continuous variable with values restricted to be within the time segment, [0;T], ranging from 0 to T, where T is the period of the periodic component determined by said step of 'determining' referred to above. Also, the variable $t_2$ is a discreet variable with values constrained such that $t_2$=mT, where m is an integer (m=1, 2, 3 . . . , M). The upper value of m may be defined as: $M=T_{acq}/T$, where $T_{acq}$ is the 'acquisition time', which is the total time duration over which all of the data points are acquired.

In other words, segmentation may be performed by enforcing these restrictions, such that each separate value of the integer 'm' defines a new segment and a step along the second time dimension, $t_2$. Each segment has a time-duration, in the first time dimension $t_1$, ranging from $t_1$=0 to $t_1$=T only. This also means that the beginning time point of each segment shares the same value of the continuous time variable $t_1$ (i.e. $t_1$=0) with the beginning time point of every other segment, but has a unique value of time $t_2$ in the second time dimension Similarly, this also means that the end time point of each segment shares the same value of the continuous time variable $t_1$ (i.e. $t_1$=T) with the end time point of every other segment, but has a unique value of $t_2$ in the second time dimension. In this sense, the different segments are "co-registered" (i.e. aligned in time) with each other in the 2D space of the 2D function, $F_2(t_1, t_2)$. Of course, it is to be understood that the actual sampled value of the image-charge/current signal are discrete values which are sampled at a finite number of discrete time points within the continuous time interval, [0;T]. This means that actual measured signal values may or may not exist (depending on the sampling rate etc.) at the exact point in time: $t_1$=0, $t_1$=T, in the segments.

For example, the step of segmenting the recorded signal into a number of separate time segments may include converting the 1D function, $F_1(t)$, into the 2D function, $F_2(t_1, t_2)$, according to the relation:

$$F_{nm} \sim F_1\left(\frac{n}{N}T + mT\right)$$

Here, $\frac{n}{N}T = t_1,\ mT = t_2$

In addition, the integer N denotes the number of data points (measurements or samples) that are available within the segment time interval [0;T]. For example, the data sampling time interval, δt, may be such that δt=T/N, and the counting integer 'n' varies in the range n=1, 2 . . . . , N. In other words, the step of segmenting may produce a matrix, $F_{nm}$, of data values comprising 'm' rows and 'n' columns. Each row of the matrix defines a unique segment, with successive rows defining a 'stack' of segments. The 'row' dimension of the row of the matrix corresponds to the first time dimension, $t_1$, whereas the 'column' dimension of the matric corresponds to the second time dimension, $t_2$. In this sense, the different segments are "co-registered" (i.e. aligned in time) with each other, and "separated" from each other, in the 2D space of the 2D function, $F_2(t_1, t_2)$.

For example, the step of segmenting the recorded signal into a number of separate time segments may include converting the 1D function, $F_1(t)$, into the 2D function, $F_2(t_1, t_2)$, according to the relation:

$$F_{nm} = \frac{1}{N_{avg}} \sum_{j=mN_{avg}}^{j=(m+1)N_{avg}} F_1\left(\frac{n}{N}T + jT\right)$$

Here, each segment in $F_2(t_1, t_2)$ is constructed as an average of $N_{avg}$ successive segments of $F_1(t)$. Possible choices of counting integers are: N=T/δt; m=1, 2, 3, . . . , M; where $M=T_{acq}/(T*N_{avg})$. Of course, setting a value of $N_{avg}$=1 means there is no averaging. If signal $F_1(t)$, is not defined at some arbitrary time, $t_i$=nT/N+jT, then its value can be interpolated using adjacent measured signal values where $F_1(t)$ is defined.

Thus, in this example, the constraint that $F_{nm}$ is a matrix function of two independent row/column coordinates defined by counting integers, 'n' and 'm' performs the steps of "co-registering" and "separating" described above according to the aspects of the invention. Any two or more matrix elements each having the same value of n are "co-registered" (i.e. aligned) with each other in the 2D space of the matrix (i.e. the matrix elements of all rows of the matrix are aligned/"co-registered" in an orderly way, to define columns of the matrix). By applying the condition that the counting integer 'm', for the elements of $F_{nm}$, increases in discrete steps (e.g. 'm' increases from 'm' to 'm+1' etc.), this causes neighbouring 'rows' of the matrix to be separated by a distance $\{T=(m+1)TN_{avg}-mTN_{avg}\}$ in the second time dimension, $t_2$. The result of these process steps is thereby to generate a stack of time segments collectively defining a 2-dimensional (2D) function, $F_2(t_1, t_2)$.

This method allows one to obtain frequency information from a time domain signal without transformation into the frequency domain. It is a very convenient and efficient way to identify the dynamics of individual ions and ion clouds. Fine structures associated with isotopes may be seen in the 2D function representing the measured signal, even during quite short acquisition times. The method allows one to identify, and correct for, perturbations in an image-charge/current signal resulting from electric field or magnetic field instabilities which may be cause, for example, by gate pulse perturbations in the electronics used to drive such fields.

Desirably, the method comprises, on a display apparatus, plotting the 2D function on a plane comprising the first time dimension and the second time dimension and representing a fixed value of, or associated with, the function, or in 3-dimensional (3D) form further comprising third dimension transverse to said plane and representing variation in the function. For example, in order to represent a fixed value of the 2D function, at a given coordinate point, $(t_1, t_2)$, in the 2D space, one may apply contouring to the representation of the 2D function in which all points within the 2D function sharing the same fixed value are joined by a contour line. This, in effect, represents the 2D function in the manner of map in which the value of the 2D function is represented by 'altitude' contours. Alternatively, or in addition, in order to represent a fixed value of the 2D function, at a given coordinate point, $(t_1, t_2)$, in the 2D space, one may apply colour-coding to the representation of the 2D function in which all points within the 2D function sharing the same fixed value are assigned the same colour, and other data points sharing a different fixed value are assigned a different colour to permit different function 'altitudes' to be distinguished visually, in the manner of a 'heat-map'.

For example, by representing a fixed value associated with the 2D function, one may define a threshold value against which the value of the 2D function may be compared. If the value of the 2D function at a given coordinate point, $(t_1, t_2)$, in the 2D space, exceeds the threshold value then that coordinate point may be represented by a first fixed value (e.g. a value 1.0) irrespective of the actual above-threshold value of the 2D function there. Conversely, if the value of the 2D function at a given coordinate point, $(t_1, t_2)$, in the 2D space, does not exceed the threshold value then that coordinate point may be represented by a second fixed value (e.g. a zero value, 0) irrespective of the actual above-threshold value of the 2D function there. The result is a 2D map, binary in value in which above-threshold locations of the 2D function are clearly distinguishable from below-threshold locations. The fixed value of 1.0 may be represented, in a display, by a first colour or shade (e.g. white), whereas the second fixed value of zero (0) may be represented in that a display by a distinct second colour or shade (e.g. black). FIG. 8, described below, is an example.

Preferably, the method may comprise determining a change in said motion of an ion according to a corresponding change in the periodic signal component within the 2D function in the first time dimension and/or in the second time dimension. For example, a periodic component, of period T, that has been identified using the 'correct' stacking period (T'=T), may present itself as a linear feature (e.g. a channel, strip or ridge, depending on how the 2D function is represented in a display) that extends across the 2D space of the 2D function. A change to be determined, or detected, may be any one or more of: a change in the direction of the linear feature; a deviation from linearity of that feature, a change in the width of that feature; a change in the height/amplitude of that feature. This change may be detected visually, by inspection and analysis, of automatically by a suitable algorithm. This deviation may signal that the period of the periodic component has changed from its initial value of T to a new value, T", in which T'≠T". As a result, the previously 'correct' stacking period, T', is no longer 'correct' and this reveals itself as a change in the appearance of the periodic component within the 2D space of the 2D function. The method may comprise determining, in the second dimension of time, a change in the position of said periodic signal component in the first dimension of time, thereby to identify a change in said oscillatory motion of an ion. For example, the position (i.e. the first time dimension) of the periodic feature may differ/change when compared within the interval [0;T] of two successive stacked segments of the 2D function. The stacking of the segments occurs in the second time dimension (e.g. such as between, $F_{nm}$ and $F_{n(m+1)}$), and the advance of time in that second dimension enables such a comparison to reveal (i.e. to more easily/accurately allow one to determine) the change in the position of said periodic signal component in the first dimension of time (i.e. within the interval [0;T]).

Desirably, the method comprises determining, in the second dimension of time, a change in the duration of said periodic signal component in the first dimension of time, thereby to identify a change in said oscillatory motion of an ion. For example, the position (i.e. the first time dimension) of the periodic feature may or may not differ/change when compared within the interval [0;T] of two successive stacked segments of the 2D function. However, the width of the feature (e.g. see FIG. 6A) may change (alone or in addition to a change in position) as time advances on the second dimension of time. Again, since the stacking of the segments occurs in the second time dimension (e.g. such as between, $F_{nm}$ and $F_{n(m+1)}$), the advance of time in that second dimension enables such a comparison to reveal (i.e. to more easily/accurately allow one to determine) the change in the duration/width of said periodic signal component in the first dimension of time (i.e. within the interval [0;T]).

The method may comprise:

identifying, from amongst said separate successive time segments, time segments containing two or more periodic signal components in successive time segments; and, resolving two or more different mass-to-charge ratios (m/q) of said ions according to the two or more different periodic signal components within the 2D function. For example, a first periodic component, of period $T_1$, that has been identified using the 'correct' stacking period ($T'=T_1$), may present itself as a first linear feature (e.g. a channel, strip or ridge, depending on how the 2D function is represented in a display) that extends across the 2D space of the 2D function. A simultaneous second periodic component, of period $T_2$, will consequently have been identified using the 'incorrect' stacking period ($T'=T_1 \neq T_2$) and may present itself as a second linear feature (e.g. a channel, strip or ridge, depending on how the 2D function is represented in a display) that extends across the 2D space of the 2D function in a direction oblique to the direction of the first linear feature. The length of the first linear feature may extend across the 2D space of the 2D function in a direction parallel to the second time dimension, and may have a 'width' that extends in a direction parallel to the first time dimension. The length of the second linear feature may extend across the 2D space of the 2D function in a direction oblique to the second time dimension, and may have a 'width' that extends in a direction parallel to the first time dimension.

Indeed, the length of any linear feature, whether a sole feature or one amongst other linear features, associated with a periodic component may extend across the 2D space of the 2D function in a direction parallel to the second time dimension, and may have a 'width' that extends in the a direction parallel to the first time dimension. This parallel orientation indicated that the periodic feature has been identified using the 'correct' stacking period.

A change to be determined, or detected, may be any one or more of: a change in the direction of the linear feature; a deviation from linearity of that feature; a change in the width of that feature; a change in the height/amplitude of that feature. This change may be detected visually, by inspection and analysis, of automatically by a suitable algorithm. This deviation may signal that the period of the periodic component has changed from its initial value of T to a new value, T", in which T'≠T". As a result, the previously 'correct' stacking period, T', is no longer 'correct' and this reveals itself as a change in the appearance of the periodic component within the 2D space of the 2D function.

The method may comprise determining a fragmentation of a said ion according to a bifurcation (e.g. a forking or splitting into two parts), in the second dimension of time, of the periodic signal component within the first dimension of time. For example, the fragmentation of an ion may cause a previously 'correct' stacking period (T'=T) for an identified periodic component, to spontaneously become 'incorrect' when an ion fragments in to two fragmentation products which each create a respective periodic component in the image-charge/current signal which has a period ($T_{fragment}$) differs from period of the parent ion (T). The result may be revealed as a splitting, forking or other form of bifurcation as the linear feature associated with the parent ion also fragments into two separate linear features (e.g. see FIG. 8) extending along the 2D space of the 2D function.

The method may comprise determining a time at which said change occurs, and applying a subsequent analytical process only to parts of the recorded signal generated before the time at which said change occurs. Desirably, the method comprises determining a time at which said change occurs, and applying a subsequent analytical process only to parts of the recorded signal generated after the time at which said change occurs. In this way, analysis may be focused on those parts of the signal relevant to a particular condition of the ion(s) in question (e.g. before ion fragmentation, or after ion fragmentation). This makes analysis much more versatile and precise.

The method may comprise identifying, in the second dimension of time, a change in the position and/or duration of said periodic signal component in the first dimension of time, thereby to identify an instability in an electric field and/or magnetic field of said ion analyser apparatus. It has been found that instabilities in an ion analyser apparatus can be detected according to the invention, and this allows users to determine not only when data may be corrupted, but also may permit corrupted data to be corrected thereby saving valuable data that would otherwise be lost.

The method may comprise correcting the 2D function based on the identified change to render said position of said periodic signal component in the first dimension of time, substantially unchanging in the second dimension of time. For example, this may be done by changing (e.g. transforming, by a mathematical transform applied to data) the time axis of a recorded transient signal feature (i.e. in the first time dimension, [0;T]) so that the frequency of the signal (i.e. change in the second time dimension) is constant in that transformed dimension.

In the method, desirably, the signal processing unit is preferably configured to determine said value for the period of a periodic signal component by iteratively:

segmenting the recorded signal into a number of separate successive time segments of duration corresponding to a trial period; and, co-registering the separate time segments in said first time dimension defining the trial period; and, separating the co-registered time segments along said second time dimension thereby to generate a said stack of time segments collectively defining a said 2-dimensional (2D) function; and, determining whether the position of the periodic component in the first time dimension changes along the second time dimension, the iterative process ending when it is determined that substantially no such change occurs.

The method may include determining a sub-set of instances of the 2D function in which the value of the 2D function falls below (or alternatively, falls above) a pre-set threshold value; and, from amongst said sub-set of instances, and within each separate time segment, determining an interval of time in the first time dimension during which the 2D function never falls below (or alternatively, never falls above) said pre-set threshold value;

identifying the interval of time as containing the periodic signal component (or alternatively, as not containing the periodic signal component). The interval of time may be the "continuous sub-interval of time" referred to above. This enables identification of a 'correct' stacking period may be done by detecting or identifying when a continuous sub-interval of time exists/appears within the stacking interval [0;T'], where there is an absence of any signal data points (or at least an insignificant number of them, such as fewer than 5%, or 2% or 1% of them) which have a signal value below an appropriate threshold value.

The method may comprise determining in the second dimension of time, a change in the duration of said interval of time in the first dimension of time, thereby to identify a change in said oscillatory motion of an ion. The method may comprise determining in the second dimension of time, a change in the position of said interval of time in the first dimension of time, thereby to identify a change in said oscillatory motion of an ion.

Desirably, the method may comprise identifying, from amongst said separate successive time segments, time segments containing multiple periodic signal components which occur between time segments containing only one periodic signal component, and excluding those identified segments from the stack, thereby leaving within the stack those time segments containing only one periodic signal component.

Preferably, the method may include calculating an average of values of the 2D function across some or all data extending along the second time dimension/axis, t2, for a given time point on the first time dimension/axis, $t_1$. Such an average may be calculated for several separate and successive time points, or all of the time points, on the first time dimension/axis, $t_1$. The result is to sum and average the data over the second time dimension, $t_2$. This may produce a single 1D function, $S(t_1)$, in the first time dimension, $t_1$, alone since the averaging process collapses the second time dimension. The 1D curve may therefore represent an averaged time-domain transient/peak associated with the periodic component within the image-charge/current signal induced by the oscillatory motion of an ion(s). It is found that the apex height/amplitude of a peak feature formed in the resulting 1D function, $S(t_1)$, is proportional to the amount of charge on the ion(s) in question. The method may include measuring/determining value for the apex height/amplitude of a peak feature formed in the resulting 1D function, $S(t_1)$, and determining the charge of the ion(s) accordingly. The method may include providing a predetermined calibration curve or table, which relates a measured apex height/amplitude with ion charge, and determining the ion(s) charge using the measured apex height/amplitude and the calibration curve, or table. The apex height/amplitude may be determined by determining the maximal value of the 1D function, $S(t_1)$, or may be more accurately determined e.g. fitting the 1D function, $S(t_1)$, or at least the part of that curve containing the peak feature, to a Gaussian curve, a parabolic curve, or via an RC circuit signal fitting.

Preferably, the method may include generating a 1D function, S(t), by multiplying a value of the 1D function $F_1(t)$, at sampling time point $t_i$, with the value of a predetermined periodic function $G(t_i)$, at the same respective sampling time point $t_i$. The pre-determined periodic function $G(t_i)$ preferably has a period. T, that is equal to the period of the periodic component that has been identified within the image-charge/current signal generated by the oscillatory motion of an ion. This multiplication procedure may be repeated at a plurality of separate sampling time points $t_i$. The resulting products may then be summed. The result is as an integrated or 'accumulated' function. This may be embodied as a scalar product, $F_1(t)\cdot G(t)$, of two vectors, $F_1(t)$ and G(t), as follows:

$$S(t) = \sum_{t_i=0}^{t} F_1(t_i)G(t_i)$$

Where, $$F_1(t) = [F_1(t_0), F_1(t_1), \ldots, F_1(t_i), \ldots, F_1(t)]^T$$

$$G(t) = [G(t_0), G(t_1), \ldots, G(t_i), \ldots, G(t)]^T$$

Here, $G(t_i)$ is the pre-determined periodic function with period of T, this being the period of the periodic component that has been identified within the image-charge/current signal generated by the oscillatory motion of an ion, as described above. Thus, $G(t_i)=G(t_i+nT)$, where n=1, 2, 3, . . . is an integer. The result is an accumulated function S(t) which is defined over some or, or the whole of, the data acquisition time interval: $t=[0:T_{acq}]$. The periodic function, $G(t_i)$, may be a sinusoidal function (e.g. $G(t_i)\sim\cos(2\pi t_i/T)$), or may be composed of a succession (e.g. a 'comb' function) of regularly-spaced (in time) Gaussian functions or delta functions, in which the regular spacing between the component Gaussian or delta basis functions is equal to the period, T, of the periodic component. If the periodic function, $G(t_i)$, is a sinusoidal function (e.g. ~'sin' or ~'cos' function, or an exponential basis, $\sim\exp(-i2\pi\cdot t/T)$), then it is not necessary to select an appropriate phase of the function—any phase is appropriate.

However, for other forms of the periodic function, $G(t_i)$, (e.g. non-sinusoidal, such as Gaussian functions or delta functions) one may preferably select an appropriate phase of the periodicity within $G(t_i)$, for improved results. This phase preferably corresponds to the phase of the periodic components within their intervals [0;T]. In other words, the phase may preferably correspond to a time, $0\leq t'\leq T$, within the very first segment [0;T], when an ion produces the very first signal pulse on the pick-up detector. As an example, if t'=T/4 then the phase of the periodic function, $G(t_i)$, may be selected so that the first Gaussian function, or delta function etc., is centred at the time t'=T/4 with all subsequent Gaussian function, or delta function etc., following at regular, periodic time intervals, T.

It has been found that if the period, T, of the periodic component (component frequency, f=1/T) remains constant, then the magnitude of the accumulated function, S(t), grows linearly with time (t) with a substantially constant rate of change (i.e. underlying 'slope' of rise). However, if the period of the periodic component changes (i.e. $T\rightarrow T^*\neq T$), then the rate of change (i.e. 'slope' of rise) of the magnitude of the accumulated function, S(t), also changes. This change in period occurs when the ion(s) responsible for generating the image-charge/current signal generated by the oscillatory motion, escapes from stable oscillatory motion.

It is found that the rate of change of the magnitude of the function, S(t), (i.e. the slope of the growth of the accumulated function S(t)) within the data acquisition time interval: $t=[0:T_{acq}]$, is proportional to the charge, z, of the ion:

$$\frac{dS(t)}{dt} = az + b$$

Here the terms 'a' and 'b' are constant, predetermined calibration values. The charge, z, of the ion may be determined according to this equation. The method may include determining a value of the charge of the ion(s) according to the rate of change (i.e. 'slope' of rise) of the magnitude of the accumulated function, S(t).

In a second aspect, the invention may provide an ion analyser apparatus configured to generate an image charge/current signal representative of one or more ions undergoing oscillatory motion therein, wherein the ion analyser apparatus is configured to implement the method described above.

The step of obtaining a recording of the image-charge/current signal generated by the ion analyser apparatus in the time domain may include obtaining a plurality of image charge/current signals before processing the plurality of image charge/current signals by said signal processing unit.

Obtaining the plurality of image charge/current signals may include:

- producing ions;
- trapping the ions such that the trapped ions undergo oscillatory motion; and,
- obtaining a plurality of image charge/current signals representative of the trapped ions undergoing oscillatory motion using at least one image charge/current detector.

Preferably, the ion analyser apparatus comprises any one or more of: an ion cyclotron resonance trap; an Orbitrap® configured to use a quadro-logarithmic electric field for ion trapping; an electrostatic linear ion trap (ELIT); a quadrupole ion trap; an ion mobility analyser; a charge detection mass spectrometer (CDMS); Electrostatic Ion Beam Trap (EIBT); Orbital Frequency Analyser (OFA), a Planar Electrostatic Ion Trap (PEIT), for generating said oscillatory motion therein. An example of a PEIT is disclosed in: "A Simulation Study of the Planar Electrostatic Ion Trap Mass Analyzer" by Li Ding, Ranjan Badheka, Zhengtao Ding, and Hiroaki Nakanishi; J. *Am. Soc. Mass*

*Spectrom.* 2013, 24, 3, 356-364. Another example is disclosed in international patent application document WO2016083074A1 (Rusinov, et al.), the entirely of which is incorporated herein by reference.

In a third aspect, the invention may provide an ion analyser apparatus configured for generating an image-charge/current signal representative of oscillatory motion of one or more ions received therein, the apparatus comprising:

an ion analysis chamber configured for receiving said one or more ions and for generating said image charge/current signal in response to said oscillatory motion;

a signal recording unit configured for recording the image charge/current signal as a recorded signal in the time domain;

a signal processing unit for processing the recorded signal to:

determine a value for the period of a periodic signal component within the recorded signal;

segment the recorded signal into a number of separate successive time segments of duration corresponding to the determined period;

co-register the separate time segments in a first time dimension defining the determined period; and, separate the co-registered time segments along a second time dimension transverse to the first time dimension thereby to generate a stack of time segments collectively defining a 2-dimensional (2D) function which varies both across the stack in said first time dimension according to time within the determined period and along the stack in said second time dimension according to time between successive said time segments.

The ion analyser apparatus may be configured for producing ions. The ion analysis chamber may be configured for trapping the ions such that the trapped ions undergo oscillatory motion, and obtaining a plurality of image charge/current signals representative of the trapped ions undergoing oscillatory motion using at least one image charge/current detector.

The ion analysis chamber may comprise any one or more of: an ion cyclotron resonance trap; an Orbitrap® configured to use a hyper-logarithmic electric field for ion trapping; an electrostatic linear ion trap (ELIT); a quadrupole ion trap; an ion mobility analyser; a charge detection mass spectrometer (CDMS); Electrostatic Ion Beam Trap (EIBT); Orbital Frequency Analyser (OFA), a Planar Electrostatic Ion Trap (PEIT), for generating said oscillatory motion therein.

In another aspect, the invention may provide a computer-readable medium having computer-executable instructions configured to cause a mass spectrometry apparatus to perform a method of processing a plurality of image charge/current signals representative of trapped ions undergoing oscillatory motion, the method being as described above. The signal processing unit may comprise a processor or computer programmed or programmable (e.g. comprising a computer-readable medium containing a computer program) to implement the configured to execute the computer-executable instructions.

Herein, the term "recording", as a verb, may be taken to include a reference to making a contemporaneous record of a signal as the signal is generated, and may be taken to include a reference to recording data representing a signal, e.g. by recording/making a copy of pre-recorded such data, or obtaining such a recording. The term "recording", as a noun, may be taken to include a reference to the result of the act of 'recording'.

Herein, the term "time domain" may be considered to include a reference to time considered as an independent variable in the analysis or measurement of time-dependent phenomena. Herein, the term "frequency domain" may be considered to include a reference to frequency considered as an independent variable in the analysis or measurement of time-dependent phenomena.

The term "periodic" used herein may be considered to include a reference to a phenomenon (e.g. a signal transient, or peak, or pulse) appearing or occurring at intervals. The term "period" includes a reference to the interval of time between successive occurrences of the same event or state, or substantially the same event or state, in an oscillatory or cyclic phenomenon.

The term 'segmenting', as a verb, may be taken to include a reference to dividing something into separate parts or sections. The term "segment", as a noun, may include a reference to each of the parts into which something is or may be divided.

The term "co-registering", as a verb, may be considered to include a reference to the process of aligning two or more items together within the domain (e.g. time domain) in which both items are represented or defined. The process may involve designating one item as the reference item and applying geometric transformations, coordinate transformations or local displacements, or numerical/mathematical constraints within the domain, to the other item so that it aligns with the reference item.

The invention includes the combination of the aspects and preferred features described except where such a combination is clearly impermissible or expressly avoided.

SUMMARY OF THE FIGURES

Embodiments and experiments illustrating the principles of the invention will now be discussed with reference to the accompanying figures in which.

DETAILED DESCRIPTION OF THE INVENTION

Figure 1A:
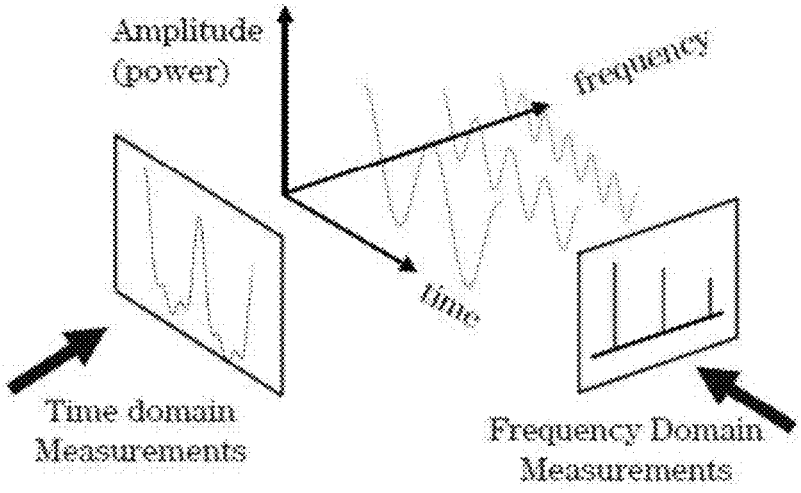
FIG. 1A shows a schematic diagram relating to the generation of a time-frequency distribution function.
Figure 1B:
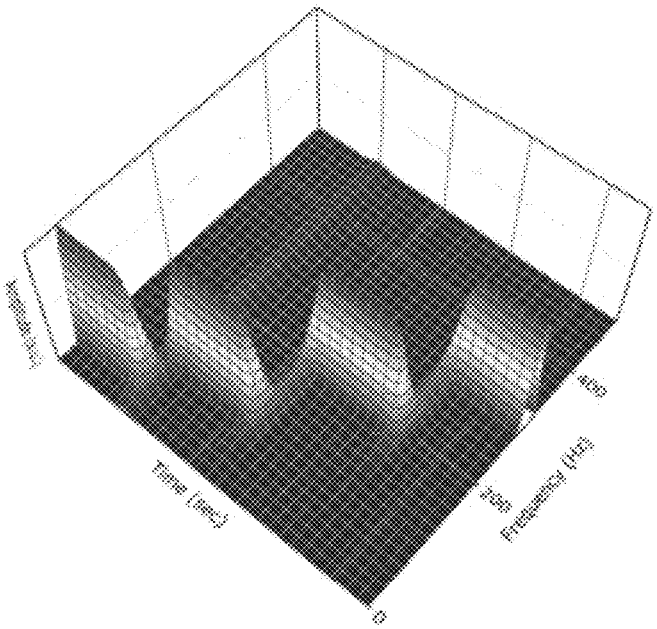
FIG. 1B shows an example of a 2D time-frequency distribution function.

Aspects and embodiments of the present invention will now be discussed with reference to the accompanying figures. Further aspects and embodiments will be apparent to those skilled in the art. All documents mentioned in this text are incorporated herein by reference.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising" and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

In the drawings, like items are assigned like reference symbols, for consistency.

Figure 2:
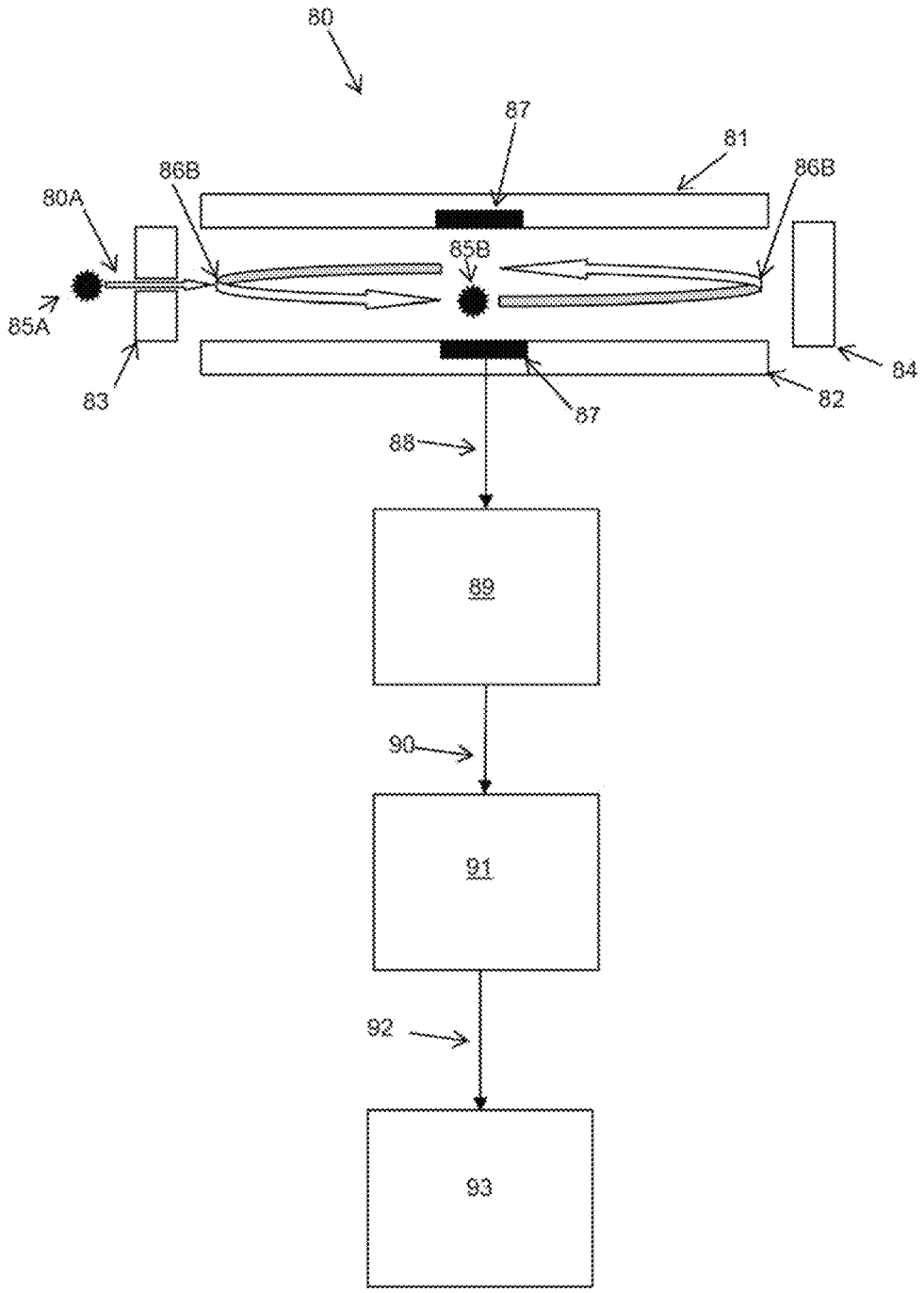
FIG. 2 shows a schematic representation of an ion analyser apparatus.

FIG. 2 shows a schematic representation of an ion analyser apparatus in the form of an electrostatic ion trap 80 for mass analysis. The electrostatic ion trap includes an ion analysis chamber (81, 82, 83, 84) configured for receiving one or more ions 85A and for generating an image charge/current signal in response to oscillatory motion 86B of the received ions 85B when within the ion analysis chamber. The ion analysis chamber comprises a first array of electrodes 81 and a second array of electrodes 82, spaced from the first array of electrodes by a substantially constant separation distance.

A voltage supply unit (not shown) is arranged to supply voltages, in use, to electrodes of the first and second arrays of electrodes to create an electrostatic field in the space between the electrode arrays. The electrodes of the first array and the electrodes of the second array are supplied, from the voltage supply unit, with substantially the same pattern of voltage, whereby the distribution of electrical potential in the space between the first and second electrode arrays (81, 82) is such as to reflect ions 85B in a flight direction 86B causing them to undergo periodic, oscillatory motion in that space. The electrostatic ion trap 80 may be configured, for example, as is describe in WO2012/116765 (A1) (Ding et al.), the entirety of which is incorporated herein by reference. Other arrangements are possible, as will be readily appreciated by the skilled person.

The periodic, oscillatory motion of ions 85B within the space between the first and second arrays of electrodes may be arranged, by application of appropriate voltages to the first and second arrays of electrodes, to be focused substantially mid-way between the first and second electrode arrays for example, as is describe in WO2012/116765 (A1) (Ding et al.). Other arrangements are possible, as will be readily appreciated by the skilled person.

One or more electrodes of each of the first and second arrays of electrodes, are configured as image-charge/current sensing electrodes 87 and, as such, are connected to a signal recording unit 89 which is configured for receiving an image-charge/current signal 88 from the sensing electrodes, and for recording the received image charge/current signal in the time domain. The signal recording unit 89 may comprise amplifier circuitry as appropriate for detection of an image-charge/current having periodic/frequency components related to the mass-to-charge ratio of the ions 85B undergoing said periodic oscillatory motion 86B in the space between the first and second arrays of electrodes (81, 82).

The first and second arrays of electrodes may comprise, for example, planar arrays formed by:

(a) parallel strip electrodes; and/or, (b) concentric, circular, or part-circular electrically conductive rings, as is described in WO2012/116765 (A1) (Ding et al.). Other arrangements are possible, as will be readily appreciated by the skilled person. Each array of the first and second arrays of electrodes extends in a direction of the periodic oscillatory motion 86B of the ion(s) 85B. The ion analysis chamber comprises a main part defined by the first and second arrays of electrodes and the space between them, and two end electrodes (83, 84). A voltage difference applied between the main segment and the respective end segments creates a potential barrier for reflecting ions 85B in the oscillatory motion direction 86B, thereby to trap the ions within the space between the first and second arrays of electrodes. The electrostatic ion trap may include an ion source (not shown, e.g. an ion trap) configured for temporarily storing ions 85A externally from the ion analysis chamber, and then injecting stored ions 80A into the space between the first and second arrays of electrodes, via an ion injection aperture formed in one 83 of the two end electrodes (83, 84). For example, the ion source may include a pulser (not shown) for injecting ions into the space between the first and second arrays of electrodes, as is described in WO2012/116765 (A1) (Ding et al.). Other arrangements are possible, as will be readily appreciated by the skilled person.

The ion analyser 80 further incudes a signal processing unit 91 configured for receiving a recorded image-charge/current signal 90 from the signal recording unit 89, and for processing the recorded signal to:

(a) determine a value for the period of a periodic signal component within the recorded signal;

(b) segment the recorded signal into a number of separate successive time segments of duration corresponding to the determined period;

(c) co-register the separate time segments in a first time dimension defining the determined period; and, (d) separate the co-registered time segments along a second time dimension transverse to the first time dimension thereby to generate a stack of time segments collectively defining a 2-dimensional (2D) function which varies both across the stack in said first time dimension according to time within the determined period and along the stack in said second time dimension according to time between successive said time segments.

These signal processing steps are implemented by the signal processing unit 91, and will be described in more detail below. The signal processing unit 91 comprises a processor or computer programmed to execute computer program instructions to perform the above signal processing steps upon image charge/current signals representative of trapped ions undergoing oscillatory motion. The result is the 2D function. The ion analyser 80 further incudes a display unit 93 configured to receive data 92 corresponding to the 2D function, and to display the 2D function to a user.

Figure 3A:
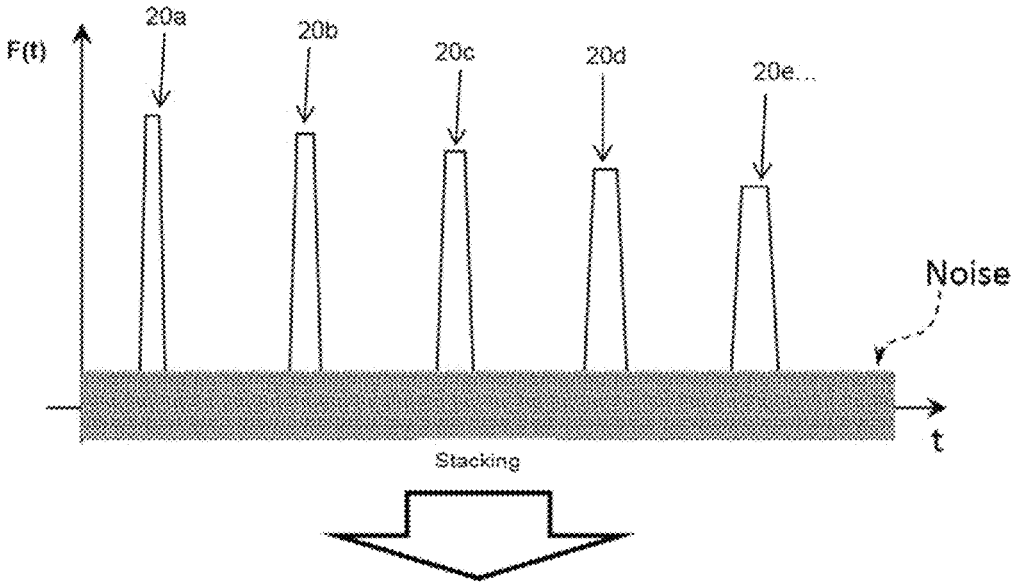
FIG. 3A shows a schematic representation of an image-charge/current signal representative of oscillatory motion of one or more ions in an ion analyser apparatus.

FIG. 3A shows a schematic representation of a one-dimensional time-domain image-charge/current signal, $F_1(t)$, generated by an ion analyser 80 of FIG. 2. The signal corresponds to the recorded image-charge/current signal 90 received by the signal processor 91 from the signal recording unit 89, and is representative of the oscillatory motion of one or more ions in the ion analyser apparatus. The signal consists of a sequence of regularly-spaced sequence of brief (or transient), but intense, image-charge/current signal pulses (20*a*, 20*b*, 20*c*, 20*d*, 20*e* . . . ) each being separated, one from another, by intermediate intervals of mere noise in which no discernible transient signal pulse is present. Each transient signal pulse corresponds to the brief duration of time when an ion 85B, or a group of ions, momentarily passes between the two opposing image-charge/current sensing electrodes 87 of the electrostatic ion trap 80 during the oscillatory motion of the ion(s) within the ion trap.

The period of oscillations by definition is the time distance between two reflections (e g states where ion kinetic energy is minimal and its potential energy is maximal. In symmetric systems, one can consider that an ion's oscillation period is the signal period.

A first transient pulse 20*a* is generated when the ion(s) 85B passes the sensing electrodes 87, moving from left-to-right, during the first half of one cycle of oscillatory motion within the electrostatic trap, and a second transient pulse 20*b* is generated when the ion(s) passes the sensing electrodes 87 again, this time moving from right to left during the second half of the oscillatory cycle. A subsequent, second cycle of oscillatory motion generates subsequent transient signal pulses 20*c* and 20*d*. The first half of the third cycle of oscillatory motion generates subsequent transient signal pulse 20*e*, and additional transient pulses (not shown) follow as the oscillatory motion continues, one cycle after another.

Successive transient signal pulses are each separated, each one from its nearest neighbours, in the time-domain (i.e. along the time axis (t) of the function $F_1(t)$), by a common period of time, T, corresponding to a period of what is, in effect, one periodic signal that endures for as long as the ion oscillatory motion endures within the electrostatic ion trap. In this way, the periodicity of the periodic signal is related to the period of the periodic, cyclic motion of the ion(s) within the electrostatic ion trap 80, described above. Thus, the existence of this common period of time (T) identifies the sequence of transient pulses (20*a*, 20*b*, 20*c*, 20*d*, 20*e*, . . . ) as being a "periodic component" of the image-charge/current signal, $F_1(t)$. Given that the common period of time, T, necessarily corresponds to a frequency (i.e. the inverse of the common time period), then this "periodic component" can also be described as a "frequency component". The signal, $F_1(t)$, may be harmonic or may be non-harmonic, depending on the nature of the periodic oscillatory motion of the ion(s).

Figure 3B:
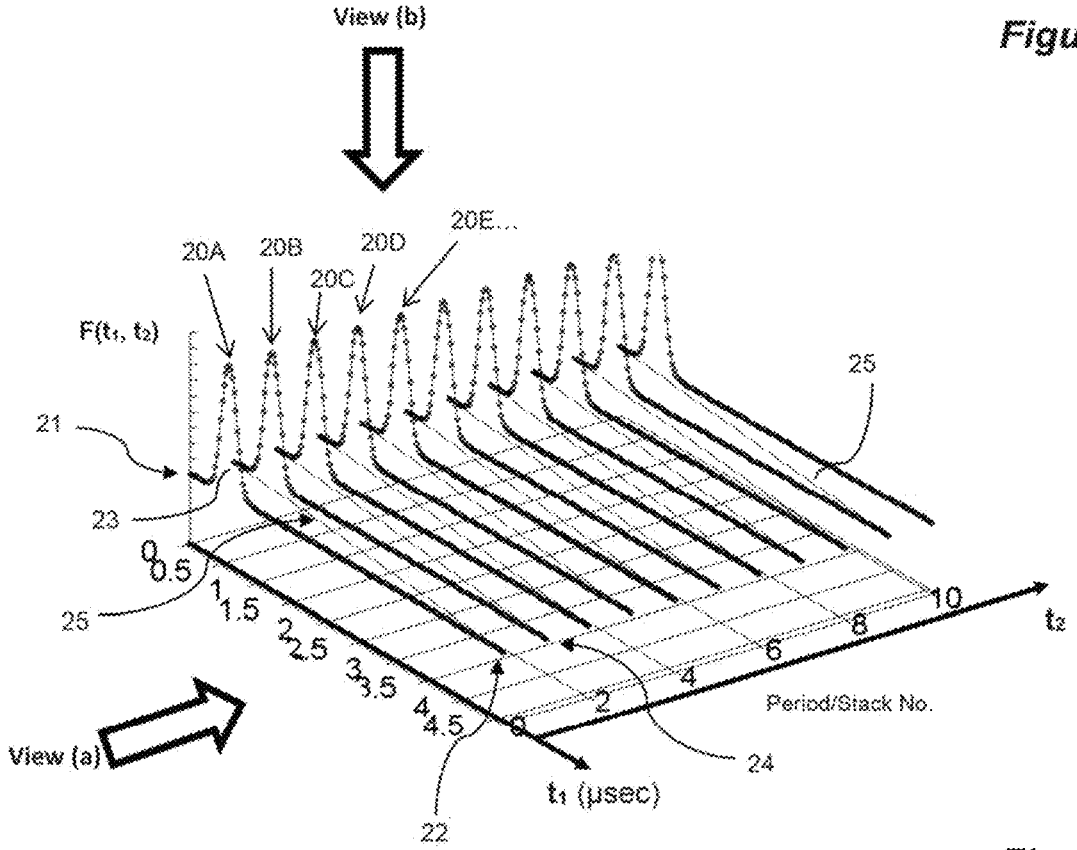
FIG. 3B shows a schematic representation of a 2D function comprising a stack of segmented portions of an image-charge/current signal representative of oscillatory motion of one or more ions in an ion analyser apparatus.

FIG. 3B shows a schematic representation of a 2D function, $F_2(t_1,t_2)$, comprising a stack of segmented portions of the image-charge/current signal, $F_1(t)$, schematically shown in FIG. 3A. This is an example of the 2D function defined by the data 92 generated by the signal processor 91 and output to the display unit 93. The signal processor 91 is configured to determine a value (T) for the period of the periodic component (20*a*, 20*b*, 20*c*, 20*d*, 20*e* . . . etc.) within the image-charge/current signal, $F_1(t)$, and then to segment the image-charge/current signal, $F_1(t)$, into a number of separate successive time segments of duration corresponding to the determined period. The signal processor is configured to subsequently co-register the separate time segments in a first time dimension, $t_1$, defining the determined period (T). Next, the signal processor 91 separates the co-registered time segments along a second time dimension, $t_2$, transverse (e.g. orthogonal) to the first time dimension. The result is to generate a stack of separate, successive time segments arrayed along the second time dimension. Collectively, this array of co-registered time segments defines the 2D function, $F_2(t_1,t_2)$, which varies both across the width of the stack in the first time dimension, $t_1$, according to time within the determined period, T, and also along the length of the stack in the second time dimension, $t_2$, according to time between successive time segments. Referring to FIG. 3B, the period, T. of the periodic component has been determined to be T=4.5 μsec, and the continuous 1D image-charge/current signal has been segmented into a plurality of time segments (20A, 20B, 20C, 20D, 20E . . . etc.) each being 4.5 μsec in duration. Each one of the time segments of the plurality of time segments has been co-registered with each one of the other time segments of the plurality of time segments. This means that the first time segment 20A is selected to serve as a "reference" time segment against which al other time segments are co-registered. To achieve this co-registration, the time coordinate (i.e. the first time dimension $t_1$) of each signal data value/point in a given time segment, other than the "reference" time segment, is subject to the following transformation of 1D time (t) into 2D time ($t_1$, $t_2$), in order to implement a step of segmenting the recorded signal into a number of separate time segments. The result is to convert the 1D function, $F_1(t)$, into the 2D function, $F_2(t_1, t_2)$, according to the relation:

$$t \rightarrow t_1+t_2$$

$$F_1(t) \rightarrow F_2(t_1,t_2) \sim F_1(t_1+t_2).$$

Here the variable $t_1$ is a continuous variable with values restricted to be within the time segment, [0;T], ranging from 0 to T, where T is the period of the periodic component. The variable $t_2$ is a discreet variable with values constrained such that $t_2$=mT, where m is an integer (m=1, 2, 3 . . . , M). The upper value of m may be defined as: $M=T_{acq}/T$, where $T_{acq}$ is the 'acquisition time', which is the total time duration over which all of the data points are acquired.

The result is equivalent to a common time displacement or translation (schematically represented by item 25 of FIG. 3B) in a negative time direction along the first time dimension sufficient to ensure that the translated time segment starts (21, 23, . . . etc.) at time $t_1$=0 and ends (22, 24, . . . etc.) at time $t_1$=T=4.5 μsec. The result is that each time segment (20A, 20B, 20C, 20D, 20E . . . etc.) receives its own appropriate time translation (see item 25 of FIG. 3B) sufficient to ensure that all time segments extend only within the time interval [0;T] along the first time dimension.

It is important to note that this registration process applies to time segments as a whole and does not apply to the location of transient signal pulses (20*a*, 20*b*, 20*c*, 20*d*, 20*e*, . . . etc.) appearing within successive time segments. However, if the time period, T, for the periodic signal component has been accurately determined, then the result of co-registering the time segments will be the consequential co-registration of the transient signal pulses, and the position of successive transient pulses along the first time dimension, will be static from one co-registered time segment to the next. This is the case in the schematic drawing of FIG. 3B, in which we see that the transient signal pulses align along a linear path parallel to the axis of the second time dimension.

Conversely, if the time period, T, for the periodic signal component has not been accurately determined, then the result of co-registering the time segments will not result in a co-registration of the transient signal pulses, and the position of successive transient pulses along the first time dimension, will change/drift from one co-registered time segment to the next.

The signal processor 91 subsequently displaces, or translates, each one of the co-registered time segments along a second time dimension, $t_2$, which is transverse (e.g. orthogonal) to the first time dimension. In particular, each signal data value/point in a given time segment, other than the "reference" time segment, is assigned an additional coordinate data value such that each signal data point comprises three numbers: a value for the signal; a time value in the first time dimension and a value in the second time dimension. The first and second time dimension values, for a given signal data point, define a coordinate in a 2D time plane, and the signal value associated with that data point defines a value of the signal at that coordinate. In the example shown in FIG. 3B, the signal value is represented as a "height" of the data point above that 2D time plane.

The time displacement or translation applied along the second time dimension is sufficient to ensure that each translated time segment is spaced from its two immediately neighbouring co-registered time segments. i.e. those immediately preceding and succeeding it, by the same displacement/spacing. The result is to generate a stack of separate, successive time segments arrayed along the second time dimension, which collectively defines the 2D function, $F_2(t_1, t_2)$, as shown in FIG. 3B. This function varies both across the width of the stack in the first time dimension, $t_1$, so as to indicate the position and shape of the transient signal pulse within the time [0;T], and also along the length of the stack in the second time dimension, $t_2$, according to time between successive time periods, or stack-segment number. Since the time interval between the beginning of the $n^{th}$, and $(n+1)^{th}$ stack, or between any two points with the same coordinate in the first time dimension, is necessarily equal to the time period, T, then the successive time segments are inherently spaced along the second time dimension by a time interval of T seconds (e.g. 4.5 μsec in the example of FIG. 3B).

Figure 4:
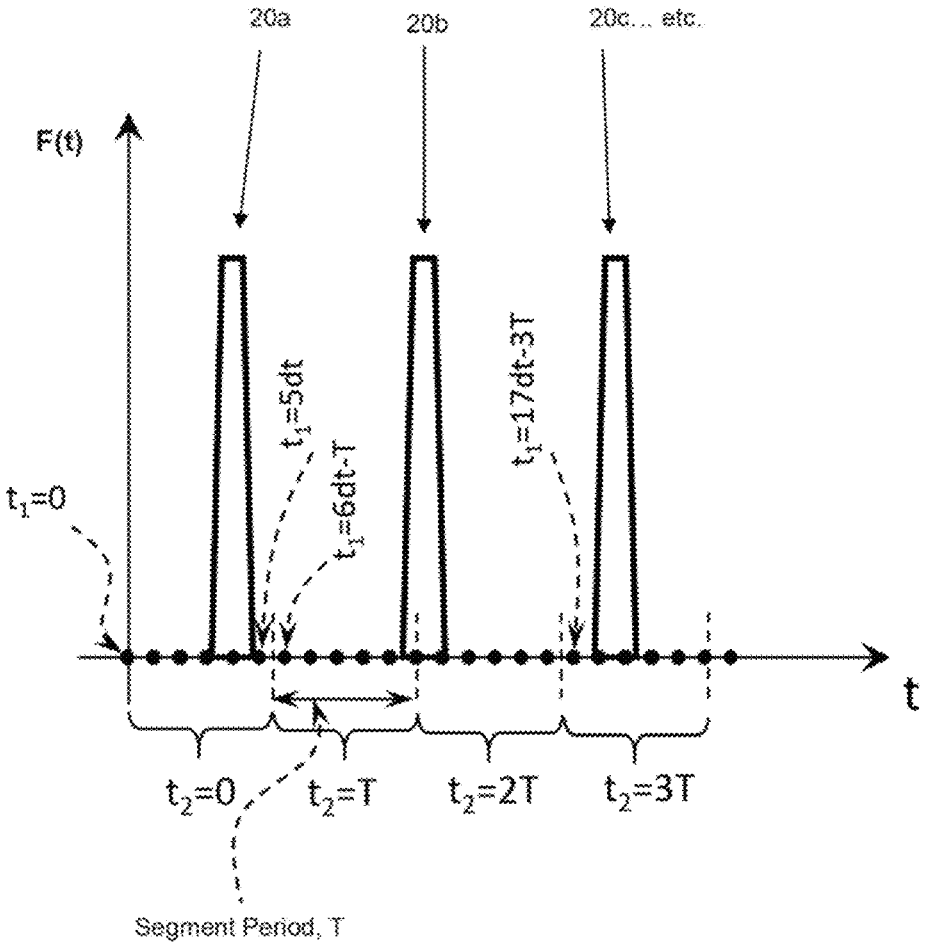
FIG. 4 shows a schematic representation of an image-charge/current signal such as shown in FIG. 3A, in which a process of segmentation is being applied.
Figure 5:
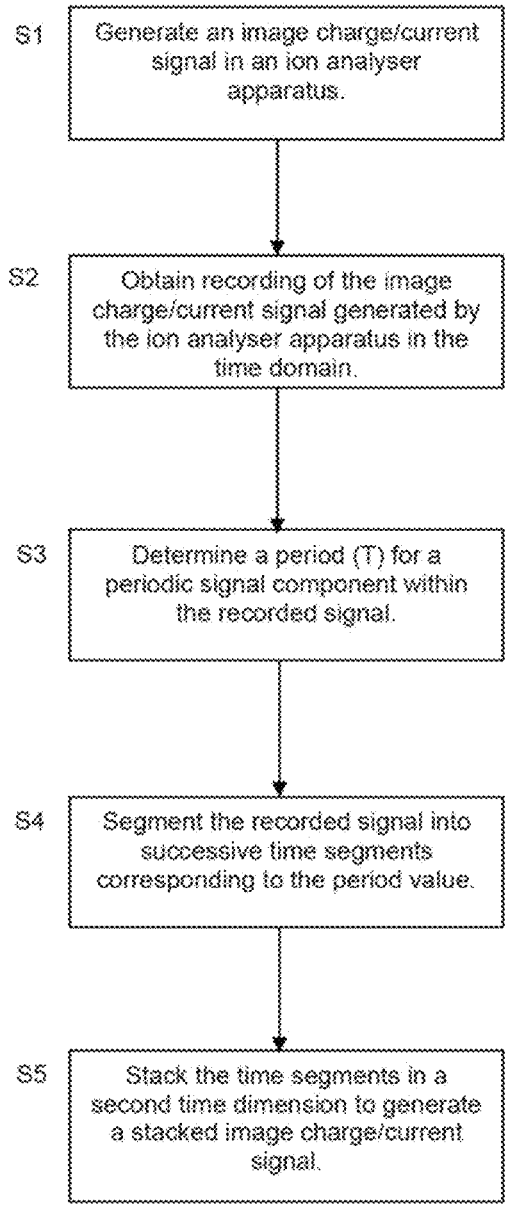
FIG. 5 shows a flow chart of steps in a process of generating a 2D function such as shown in FIG. 3B.

FIGS. 4 and 5 schematically represent the procedure for determining a value, T, for the period of the periodic signal component within the image-charge/current signal, $F_1(t)$, in the method for generating the 2D function $F(t_1,t_2)$. FIG. 5 represents the steps S1 to S5 of the method, which are implemented at steps S2 to S5. The first step in the method is to generate an image charge/current signal (step S1), and then to record the image charge/current signal in the time domain (step S2).

The acquired recording of the one-dimensional time domain image-charge/current signal, $F_1(t)$ of FIG. 4, contains one or more periodic oscillations. These periodic components may correspond to frequency components $f_1=1/T_1$, $f_2=1/T_2$ . . . etc.

Subsequently, step S3 of the method determines a period (T) for a periodic signal component within the recorded signal, and this step may comprise the following sub-steps:

(1) A first sub-step is to sample the one-dimensional time domain signal $F_1(t)$ of FIG. 4, with a sampling step of size "δt".

(2) A second sub-step is to estimate a value for the time period. $T_i$ (i=1, 2 . . . ), of each of the periodic/frequency components $f_1=1/T_1$, $f_2=1/T_2$ . . . etc. This may be done by means of any suitable spectral decomposition method as would be readily apparent the skilled person, or may be done purely by initially guessing those values and applying the present methods iteratively until a consistent result is found.

(3) A third sub-step is to segment the one-dimensional signal, $F_1(t)$, and co-register the time segments according to a chosen period (frequency) value, $f_i=1/T_i$, so as to form the 2D function $F(t_1,t_2)$. In particular, the argument t starts at $t_1=0$ (zero) and every subsequent sampling step increases along the $t_1$ axis by a step-size "δt": initially the argument $t_2=0$ (zero) during this process. After time $t_1$ is equal to or greater than T has been reached, the argument $t_2$ is reset to $t_1=0$ (zero) and the argument $t_2$ increases by a step size of T, i.e. $t_2=T$. Thus, each sampling point of the measured signal is attributed to a pair of values, ($t_1$, $t_2$). In this way a 2D mesh/plane ($t_1$, $t_2$) is formed. This constitutes a "separating" of the co-registered time segments along a second time dimension, $t_2$, transverse to the first time dimension thereby to generate a stack of time segments collectively defining a 2-dimensional (2D) function. The resulting function $F_2(t_1,t_2)$ can be thought of as a set of layers $F(t_1)$ where $t_1$ is always within interval [0;T] and each layer corresponds to a certain $t_2$ having a constant value (an integer multiple of T) within the layer.

Figure 6A:
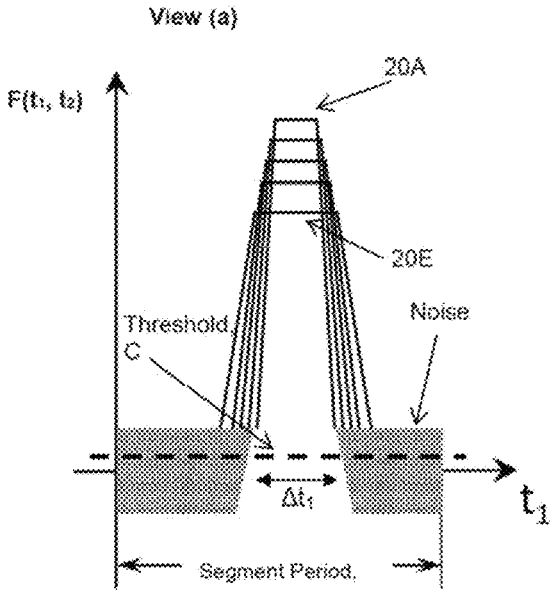
FIG. 6A shows a schematic representation of a 2D function of an image-charge/current signal such as shown in FIG. 3B, in which a process of segmentation has been applied and in which co-registration has been applied. The view shown is equivalent to the "view (a)" indicated in FIG. 3B whereby a view of a second dimension of time is suppressed, and a view of a first dimension of time is presented.
Figure 7A:
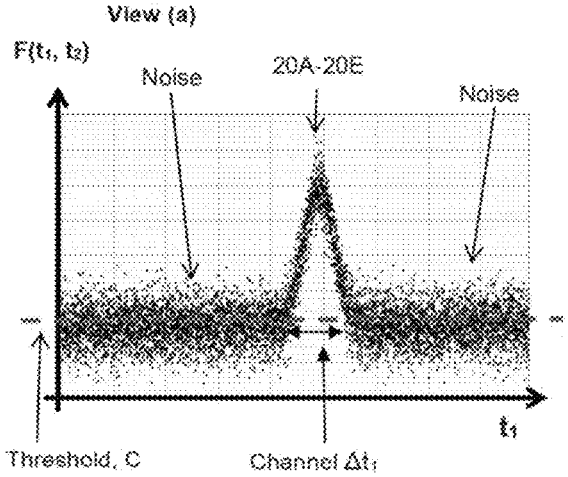
FIG. 7A shows a schematic representation of a 2D function of an image-charge/current signal such as shown in FIG. 3B, in which a process of segmentation has been applied and in which co-registration has been applied. The view shown is equivalent to the "view (a)" indicated in FIG. 3B whereby a view of a second dimension of time is suppressed, and a view of a first dimension of time is presented.

(4) A fourth sub-step, according to a first option, is to generate a first 2D scatter graph may be generated such that $F(t_1, t_2=\text{fixed})$, ignoring variation in $t_2$ values, corresponds to viewing $F_2(t_1,t_2)$ along "View (a)" and will result in all layers been seen to overlap onto each other. For a proper choice of segment period, T, a peak can be seen above noise area, as shown in FIG. 6A and FIG. 7A.

Figure 6B:
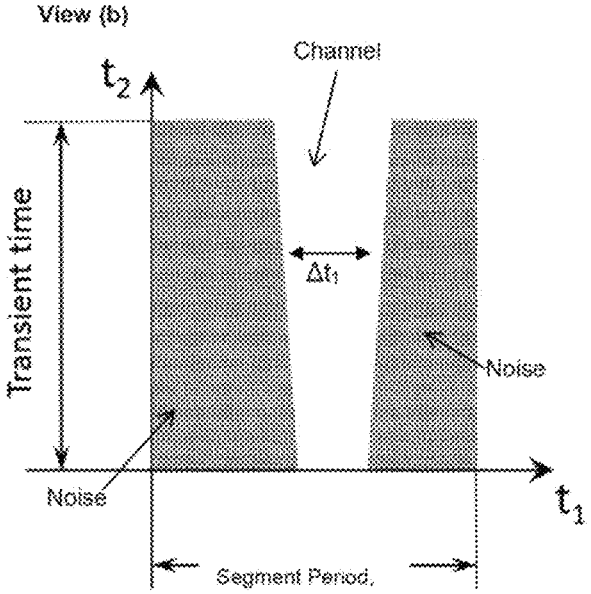
FIG. 6B shows a schematic representation of a 2D function of an image-charge/current signal such as shown in FIG. 6A, in which a process of thresholding has been applied. The view shown is equivalent to the "view (b)" indicated in FIG. 3B whereby a view of both a second dimension of time and a view of a first dimension of time are presented.
Figure 7B:
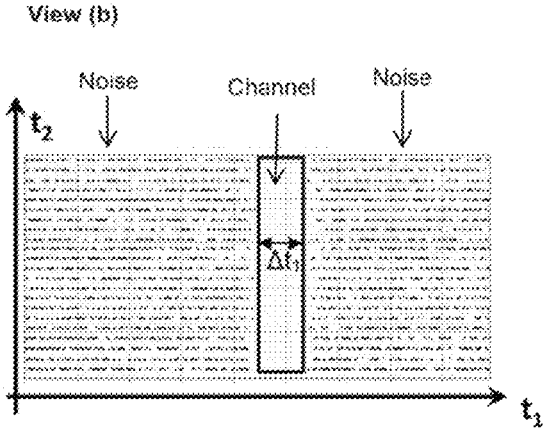
FIG. 7B shows a schematic representation of a 2D function of an image-charge/current signal such as shown in FIG. 7A, in which a process of thresholding has been applied. The view shown is equivalent to the "view (b)" indicated in FIG. 3B whereby a view of both a second dimension of time and a view of a first dimension of time are presented.
Figure 8:
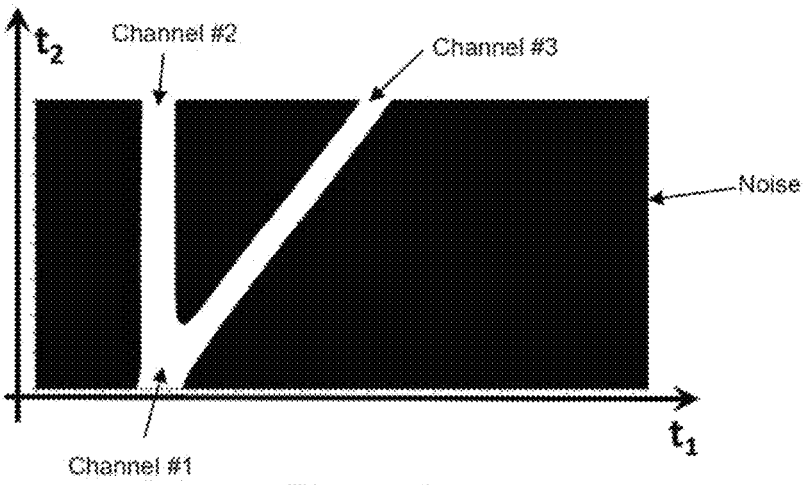
FIG. 8 shows a schematic representation of a 2D function of an image-charge/current signal such as shown in FIGS. 6B and 7B, in which a process of thresholding has been applied. The view shown is equivalent to the "view (b)" indicated in FIG. 3B whereby a view of both a second dimension of time and a view of a first dimension of time are presented.

(5) A fourth sub-step, according to a second option, is to generate a second 2D scatter graph may be generated such showing $F_2(t_1,t_2)$ subject to the following condition: plot point (t2;t1) if $|F_2(t_1,t_2)|<C$ where C is predetermined threshold value (e.g. a pre-defined signal level), otherwise skip/omit it from the plot. For a proper choice of segment period, T, a clear channel, substantially free of data points, will appear to extend along a path parallel to the $t_2$ axis, surrounded/bounded by points as shown in FIG. 6B and FIG. 7B. It is to be understood that the condition $|F_2(t_1,t_2)|>C$ is also possible, and this condition this will make a 'filled' channel with clear space around it in the 2D space.

The value for the period, T, may be arrived at iteratively, using procedures (4) or/and (5) to decide whether the chosen period value corresponding to a frequency component of signal $F_1(t)$. This decision may be based on certain criteria. For example, according to method (4), if the representation of $F_2(t_1,t_2)$ contains a peak-shaped dense area then this is categorized as a frequency component. Examples are shown in FIG. 6A and FIG. 7A. Alternatively, or in addition, according to method (5), for a pre-defined signal threshold level, C, if the representation of $F_2(t_1,t_2)$ contains a clear and substantially straight channel extending along a path parallel to $t_2$ axis, then this is categorized as a frequency component. Examples are shown in FIG. 6B and FIG. 7B. Both methods provide a means of identifying when the chosen segment period, T, (i.e. the length of each time segment) accurately matches the actual time period of the periodic component within the signal, $F_1(t)$. Only then will each transient peak of the periodic component in successive time segments 'line-up' in a linear fashion along a path parallel to the axis of the stacking dimension ($t_2$). If the chosen segment period, T, does not accurately match the actual time period of the periodic component within the signal, $F_1(t)$, then the transient peak of the periodic component in successive time segments will not 'line-up' in a linear fashion along a path parallel to the axis of the stacking dimension. Instead, the peaks will drift along a path diverging either towards the axis of the stacking dimension, or away from it.

Non-iterative methods of determining the frequency are also possible. Such methods may be faster. For example, suppose that the period of the periodic component that is initially determined, is slightly incorrect (i.e. $T'\neq T$, but not by much). The result is a linear feature extending through the 2D space of the 2D function in a direction inclined to the second time dimension ($t_2$ axis). One may find the period corresponded to this signal iteratively as described above, by iteratively re-segmenting and re-stacking the original 1D signal again and again until the linear feature is made parallel to the $t_2$ axis. Alternatively, one can determine an inclination angle which the linear path of the linear feature subtends to the axis of the first time dimension (e.g. with respect to $t_1$ axis) and get correct stacking period (i.e. T'=T), according to that angle (i.e. the angle between the $t_1$ axis and linear path direction). The advantage is one does do not need to perform iterative re-segmenting and re-stacking at all. This saves lots of computational time because usually a signal array in memory is a very large amount of data and accessing such arrays in a PC memory is a long process and is a bottleneck in processing speed. Once one has determined the inclination angle, the formula for the correct period, determined using the 'incorrect' stacking period (T') and the inclination angle, is:

$$\frac{1}{T}=\frac{1}{T'}\left(1+\frac{1}{\tan(\alpha)}\right)$$

The inclination angle, α, can be measured directly, and may be iteratively optimized by successive measurements of the inclination angle, α, made by successive versions of the linear feature for successive (improving) values of stacking period (T'). In this way, the inclination angle, α, can be used as an optimisation variable to find the condition T'=T. Optimization methods readily available to the skilled person (e.g. gradient descent) or by machine learning tools (e.g. neural networks) may be used to implement this.

Either method, namely method (4) or method (5), may be performed either by image analysis algorithms or by numerical algorithms. Preferably, such algorithms would consider the density, or number, of data points on the respective representation of $F_2(t_1,t_2)$. For example, an algorithm may determine the number of points falling below a pre-defined threshold $|F_2(t_1,t_2)|<C$ within a pre-defined time interval $\Delta t_1$ within the first time dimension. If the density, or number, of points is less than the threshold, C, then this may be used to indicate that the frequency component is suitably detected. FIGS. 6B, 7B and FIGS. 8, 9A and 9B, exemplify this method. Here the method includes determining a sub-set of instances of the 2D function in which the value of the 2D function falls below the pre-set threshold value, C. From amongst that sub-set of instances one determines the interval of time, $\Delta t_1$, in the first time dimension during which the 2D function never falls below the pre-set threshold value. One may then identify that interval of time as being the location/presence of the periodic signal component.

Algorithms may employ machine earning techniques including neural networks trained to classify images having resolved peak structures (method (4)) and/or noticeable channels (method (5)).

Once a value for the period, T, has been arrived at iteratively, the method proceeds by segmenting the recorded signal into a number of separate successive time segments of duration corresponding to the determined period (step S4). The procedure for doing this is the same as that described in the sub-step (3) of step S3. It will be appreciated that, according to the iterative method of determining the time period, T, one inherently performs method step S3 when one implements the final, successful sub-step (4) or (5) of step S3, described above.

The final step S5 of the method is to generating a stack of the time segments of step S4, in a second time domain, $t_2$, to generate a stacked image charge/current signal. The procedure for doing this is the same as that described in the sub-step (3) for co-registering the separate time segments in a first time dimension, $t_1$, defining the determined period, T, and of separating the co-registered time segments along the second time dimension, $t_2$, transverse to the first time dimension. Once more, according to the iterative method of determining the time period, T, one inherently performs method step S5 when one implements the final, successful sub-step (4) or (5) of step S3, described above.

In this method the signal processing unit may be programmed determine the value, T, for the period of a periodic signal component iteratively in this way. It may initially estimate a 'trial' value of T, as described above, and segment the recorded signal, $F_1(t)$, using that 'trial' value, into a number of time segments of duration corresponding to a 'trial' period, and co-registering them, then separate the co-registered time segments along the second time dimension, $t_2$, to generate a stack of time segments. The signal processor unit may be configured to automatically determine whether the position of the periodic component (transient peak) in the first time dimension changes along the second time dimension. If a change is detected, then a new 'trial' time period, T, is chosen by the signal processor and a new stack of time segments is generated using the new 'trial' time period. The signal processor then re-evaluates whether the position of the periodic component (transient peak) in the first time dimension changes along the second time dimension, and the iterative process ends when it is determined that substantially no such change occurs. This condition signifies that the latest 'trial' time period. T, is an accurate estimate of the true time period value.

Analysis of $F_2(t_1,t_2)$ may provide information on existing frequency components (i.e. frequency spectrum), on frequency components behaviour in time (e.g. frequency stability), on interaction of frequency components with each other, on quality/property of a system which is responsible for the signal generation. Gathered information may be useful for further analysis or can be used to do some corrections on the measured signal in order to achieve certain improvements.

For example, one may identify, from amongst separate successive time segments, those time segments containing two or more periodic signal components, and one may resolve two or more different mass-to-charge ratios (m/q) of ions according to the two or more different periodic signal components within the 2D function. For example, in FIG. 8, the chosen segment period (i.e. the length of each time segment) initially accurately matches the actual time period of the periodic component within the signal, $F_1(t)$. The result is that the initial "channel #1" of the 2D function extends in a linear fashion along a path parallel to the axis of the stacking dimension, namely the second time dimension $t_2$. However, subsequently, the "channel #1" bifurcates in to "channel #2" and "channel #3", one of which drifts along a path diverging away from the axis of the stacking dimension (cf. "channel #3"). The other fork in the bifurcation (cf. "channel #2") continues along a path parallel to the axis of the stacking dimension. This bifurcation indicates that an ion within the pack of ions 85B inside the electrostatic ion trap 80, after initially performing oscillatory motion possessing a periodic component of period T, has subsequently undergone a collision within the trap which has ionised it further and changed its m/z ratio. In addition, this picture also demonstrates fine isotopic structure elucidation. That is to say, two very close masses (different isotopes of the same species) may similarly bifurcate, or split, the channel #1 into channels #2 and #3.

The consequence is a change in the orbital dynamics of the new ion so as to change its oscillatory motion relative to that of the ion pack it once resided within and, as a result, to add a new period of periodic component to the signal associated with the new ion. The new "channel #3" corresponds to the new ion, whereas the new "channel #2" is a continuation of "channel #1" which represents the remaining pack of ions, albeit now with one less ion in it. The remaining "channel #2" continues along a path parallel to the second time dimension, $t_2$, because the stacking period, T, upon which the 2D function $F_2(t_1,t_2)$ is based, remains an accurate estimate of the period of the periodic component associated with the remaining ion pack. However, the stacking period, T, is not an accurate estimate of the period of the periodic component associated with the new ion and so "channel #3" diverges from the second time dimension. This divergence signals the creation of the new ion. Thus, the method may comprise determining a fragmentation of a said ion according to a bifurcation, in the second dimension of time, of the periodic signal component within the first dimension of time.

The stacking period, T, may then be re-estimated to identify the period $T_{new}$, of the new ion and this will be revealed when the 1D function, $F_1(t)$, is re-segmented and stacked according to a new estimate of the time period for the periodic signal component associated with the new ion, such that the path of "channel #3" extends along a linear path parallel to the second time dimension, $t_2$. Of course, this will also cause the path of "channel #2" to diverge towards the second time dimension. In this way, one may determine, in the second dimension of time, a change in the position of the interval of time associated with a periodic component in the first dimension of time, thereby to identify a change in oscillatory motion of an ion. The signal processor unit may be configured to detect this type of change.

Similarly, one may determine, in the second dimension of time, a change in the duration of the interval of time associated with a periodic component in the first dimension of time, thereby to identify a change in oscillatory motion of an ion. For example, FIGS. 3A, 6A and 6B show a 1D signal, $F_1(t)$, (cf. FIG. 3A), and alternative views of a corresponding 2D function, $F_2(t_1,t_2)$, in which the width of the transient signal peak associated with a periodic signal component, is seen to increase over successive cycles of oscillatory ion motion (cf. FIG. 6A, 6B). This increase in width is due to a spreading of the length of the ion pack along the trajectory of the ion pack within the electrostatic ion trap 80, from one oscillatory cycle to the next. By determining, in the second dimension of time, the change in the width of the channel (i.e. duration of the periodic signal component) as measured in the first dimension of time, one may identify a the occurrence of this change in the motion of the ions within the ion pack. The signal processor unit may be configured to detect this type of change.

The method may comprise determining a time at which any change occurs in the position or duration of a transient structure in the 2D function, whether in the form of a signal peak structure or a channel derived from it as explained above, and applying a desired subsequent analytical process only to parts of the recorded signal generated before (or alternatively, only after) the time at which that change occurs. This allows one to identify periods of time during which a selected type of ion motion is taking place, and to exclude periods in which other types of ion motion are occurring, which may complicate analysis or be otherwise not necessary or of use.

Figure 11:
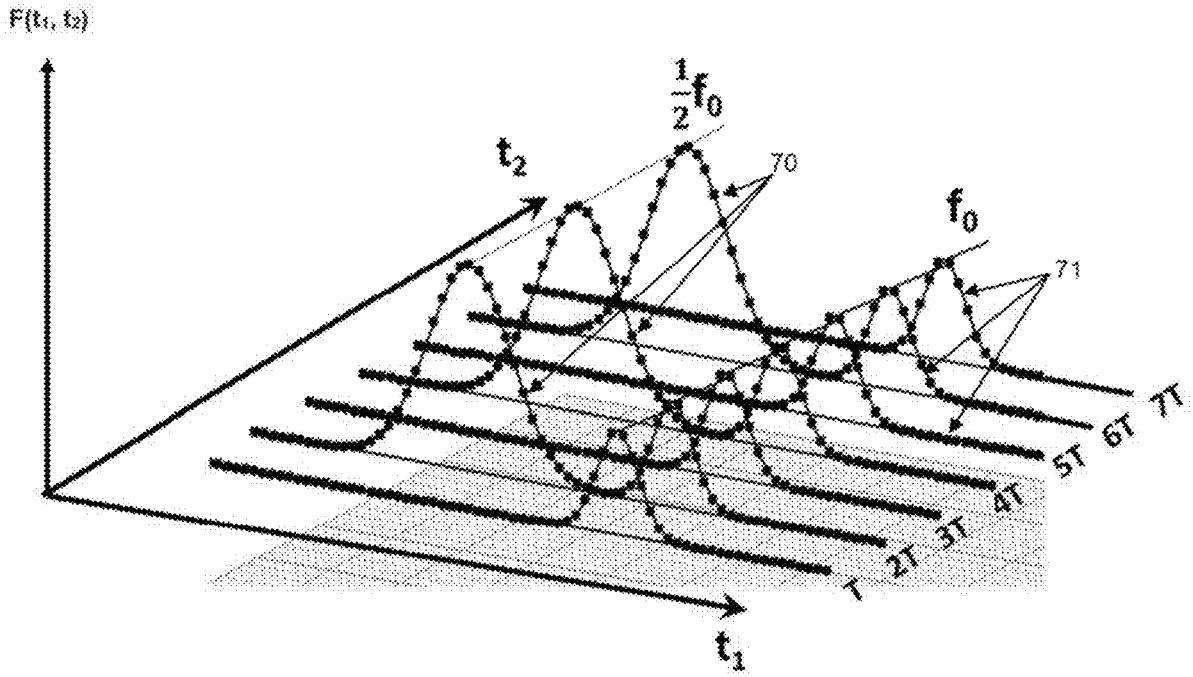
FIG. 11 shows a schematic representation of a 2D function comprising a stack of segmented portions of an image-charge/current signal representative of oscillatory motion of one or more ions in an ion analyser apparatus. Here, two periodic signal components are present, in which one component has half the frequency of the other component.
Figure 12:
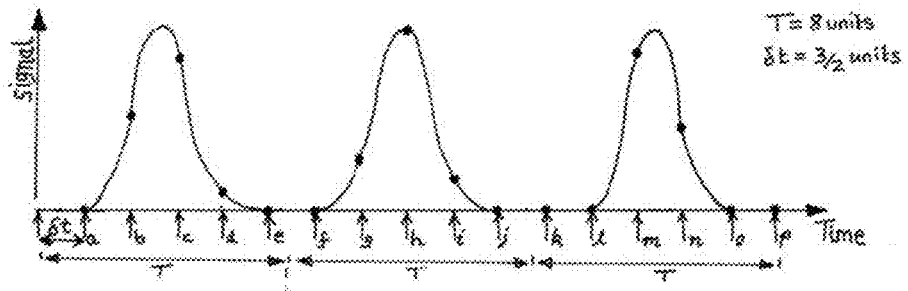
FIGS. 12(*a*), 12(*b*) and 12(*c*) show a schematic representation of: (a) a 1D function composed of a series of measured values of an image-charge/current signal containing a periodic component generated by the oscillatory motion of an ion(s) within an ion trap or analyser; and (b) the 1D function after it has been segmented and the segments co-registered in a segmentation interval [0:T'] of length equal to the period T of the periodic component; and (c) representing the 1D function after it has been segmented and the segments co-registered in a segmentation interval [0:T'] of length equal to 0.75T.
Figure 12:
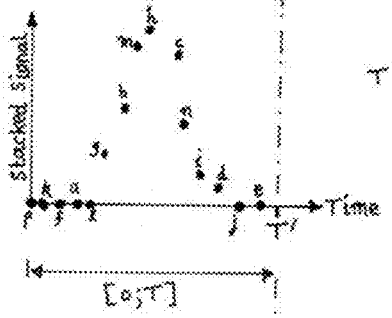
Figure 12:
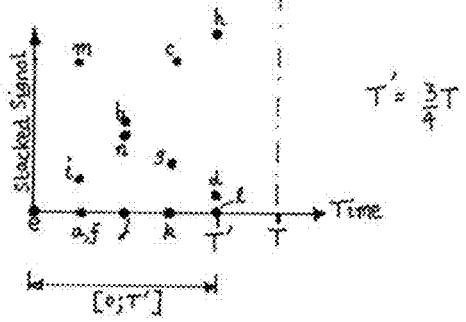

Desirably, the method may comprise identifying, from amongst said separate successive time segments, time segments containing multiple periodic signal components which occur between time segments containing only one periodic signal component, and excluding those identified segments from the stack, thereby leaving within the stack those time segments containing only one periodic signal component. FIG. 11 illustrates an example of this. In particular, a selection can be performed wherein certain undesired time segments are omitted from the stack defining the 2D function. This may be advantageous to exclude interference, for example to get rid of aliquoted frequency components. For example, with reference to FIG. 11, if we consider frequency component $f_0$ and there is $\frac{1}{2}f_0$ component in the signal as well, there will be two transient peaks in half of the time segments (i.e. every alternate time segment) defining the 2D function, $F(t_1,t_2)$.

This would be revealed as two peaks in "View (a)" of the 2D function, and as two channels in "View (b)" of the 2D function after the threshold, C, has been applied to it. However, if we consider segment by segment we find that only every alternate time segment contains two peaks, one associated with the frequency component $\frac{1}{2}f_0$ and the other associated with the frequency component $f_0$. Each such alternate time segment is followed by an adjacent time segment containing only one peak associated with the frequency component $\frac{1}{2}f_0$, as shown in FIG. 11. Thus, in order to be rid of the frequency component $\frac{1}{2}f_0$, one may skip or discard time segments located in the second time dimension at times $t_2$=2T, 4T, 6T and so on (see FIG. 11) so as to provide a form of the 2D function representing only the frequency component $\frac{1}{2}f_0$. In a similar way it is possible to get rid of other frequency components with aliquoted frequencies (periods). In general, these are combinations of $f_0$ and $(m/n)f_0$ (m, n are integers, m<n), we may skip respective layers so that only $f_0$ components are present in the signal.

Averaging may be performed by combining the data associated with multiple time segments, for example by combining the data associated with the following time points along the second time dimension $t_2$=kT, $t_2$=(k+1)T, . . . $t_2$=(k+$N_{avg}$)T, ($N_{avg}$, an integer), which each share the same point sampling point of $t_1$ upon the first time dimension of the 2D spaces. For example, the data points for successive time segments having the same position along the $t_1$ axis, but spaced along the $t_2$ axis, may be summed and the result divided the result by $N_{avg}$. Interpolation of values of the 2D function, $F_2(t_1,t_2)$, is required with respect to $t_1$ axis. Averaging is advantageous for low intensity signals, i.e. when the signal-to-noise (S/N) ratio is small. For example, the step of segmenting the recorded signal into a number of separate time segments may include converting the 1D function, $F_1(t)$, into the 2D function, $F_2(t_1, t_2)$, according to the relation:

$$F_{nm} = \frac{1}{N_{avg}} \sum_{j=mN_{avg}}^{j=(m+1)N_{avg}} F_1\left(\frac{n}{N}T + jT\right)$$

Here, each segment in $F_2(t_1, t_2)$ is constructed as an average of $N_{avg}$ successive segments of $F_1(t)$. Possible choices of counting integers are: N=T/δt; m=1, 2, 3, . . . , M; where $M=T_{acq}(T*N_{avg})$. Of course, setting a value of $N_{avg}$=1 means there is no averaging.

If necessary, or desired, parts of the 2D space of the 2D function, $F_2(t_1,t_2)$, where no data point or measured value is available or present (i.e. where $F_2(t_1,t_2)$ is undefined), may be generated by interpolation between existing data points of $F_2(t_1,t_2)$. For example, if the signal $F_1(t)$ is not defined at some arbitrary time, $t_i$, then its value can be interpolated using adjacent measured signal values where $F_1(t)$ is defined. For example, one may create a mesh within the segmentation interval, [0:T], and interpolate values of the signal whenever sampling points do not fall onto the mesh nodes. For example, suppose that to interpolate a value for $F_1(t)$ at an interpolation time point, $t_c$, where no measured data value exists. If the interpolation time point falls into interval $[t_a; t_b]$, where measured data values exist at both time points $t_a$ and $t_b$, then one may use linear interpolation using the values $F_1(t_a)$ and $F_1(t_b)$ to generate/interpolate a value for $F(t_c)$. Other types are also possible of course.

Figure 9A:
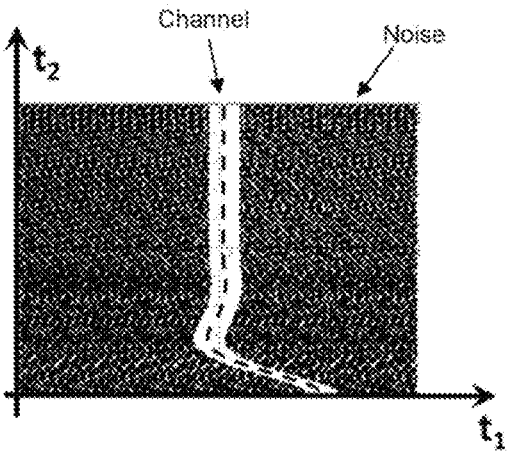
FIG. 9A shows a schematic representation of a 2D function of an image-charge/current signal such as shown in FIGS. 6B and 7B, in which a process of thresholding has been applied. The view shown is equivalent to the "view (b)" indicated in FIG. 3B whereby a view of both a second dimension of time and a view of a first dimension of time are presented. The periodic signal component changes in position due to field instabilities in the ion analyser apparatus used to generate the image-charge/current signal.
Figure 9B:
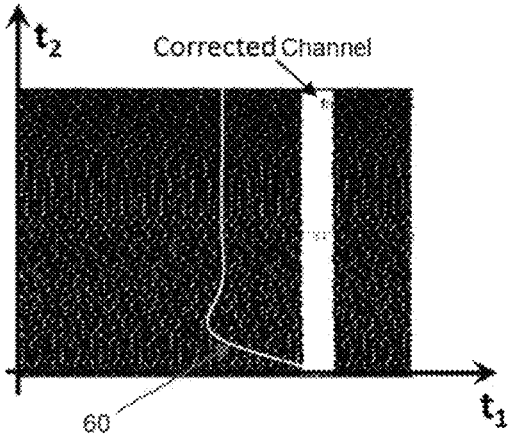
FIG. 9B shows a schematic representation of a 2D function of an image-charge/current signal corresponding to a corrected version of the 2D function of FIG. 9A, in which changes in the position of the periodic signal component are corrected.
Figure 10:
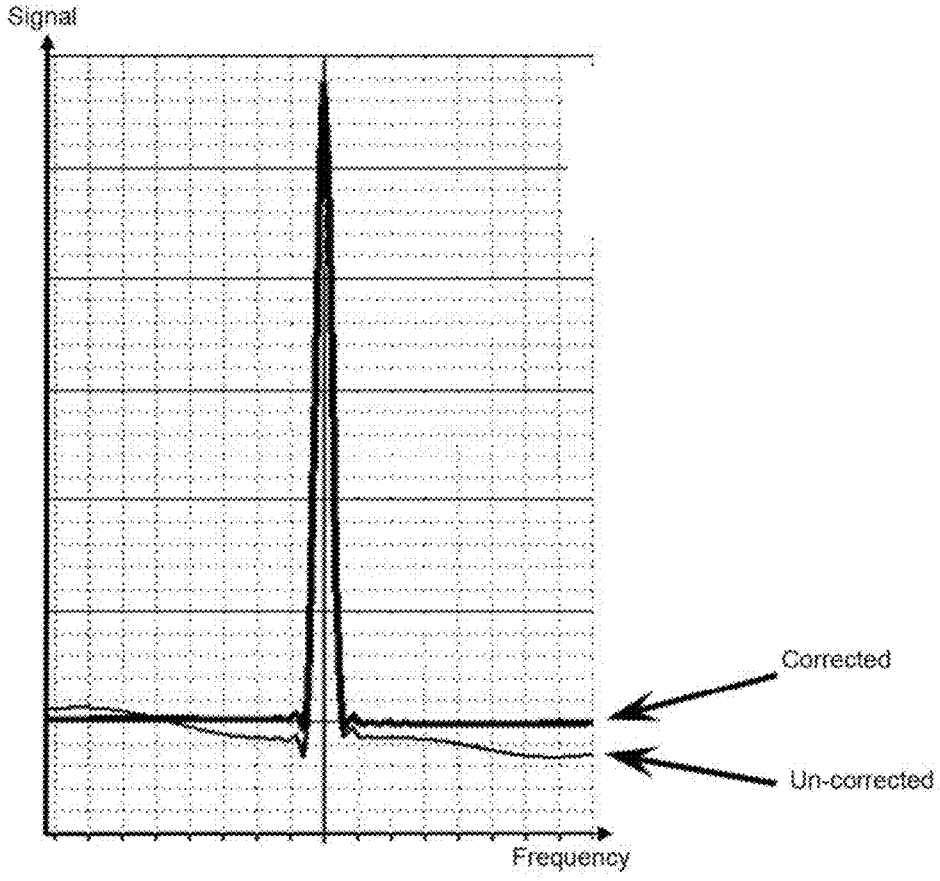
FIG. 10 shows a Fourier transform frequency spectrum of the periodic signal component corresponding to the 2D function illustrated in FIGS. 9A and 9B, both before and after correction of the position of the periodic signal component.

Furthermore, the method permits one to identify an instability in an electric field and/or magnetic field of said ion analyser apparatus. Such instabilities are revealed, in the second dimension of time, as a change in the position and/or duration of a periodic signal component in the first dimension of time. FIGS. 9A, 9B and 10 illustrate examples of this. For example, the method may include identifying, in the second dimension of time, a change in the position and/or duration of the periodic signal component in the first dimension of time, thereby to identify an instability in an electric field and/or magnetic field of the ion trap apparatus, 80.

Referring to FIG. 9A, a waving of the "channel" formed by a periodic component within the 2D function, $F_2(t_1,t_2)$, when subject to the threshold, C, condition, indicates that the instantaneous frequency of this periodic component is not stable due to electrical field instability inside the ion trap, 80. This kind of analysis allows one to estimate an instability of the power supply and it is extremely sensitive compared to conventional electrical circuit measurements. In particular, the "channel" formed by the instantaneous period changes can be used to correct time axis in the first time dimension, $t_1$, so that this period becomes stable over the second time dimension, $t_2$, and the "channel" attains a straight path parallel to the second time dimension.

To achieve this, the signal processor unit maybe configured to determine a function $G(t_2)$ which reflects non-linear path indicated in FIG. 9A. The function $G(t_2)$ is a line following centre of the "channel" (or, alternatively, the position of the transient signal peak maximum) within the 2D function. The value of $G(t_2)$ at a given time in the second dimension, $t_2$, is simply equal to the value of $t_1$ corresponding to the projection of the non-linear path upon the first time dimension. Thus, $G(t_2)$ can be obtained by reading position, $t_1$, of the centre of the "channel" within the 2D function, as shown in FIG. 9A, or the position, $t_1$, of a peak in the 2D function if the threshold condition, C, is not being applied, in each time segment of the stack defining the 2D function.

The instantaneous period T(t) can be determined via $G(t_2)$ using formula:

$$T(t)=T\times(dG(t_2)/dt_2+1),$$

where T' is the period used to generate the 2D function, $F_2(t_1,t_2)$. The derivative, $(dG(t_2)/dt_2)$, can be calculated either analytically or numerically.

Next, the time axis or the time domain signal is corrected according to the following formula:

$$\delta t_i=\delta t\times T'/T(t_i)$$

which defines the current time-step (sampling step, $\delta t_i$), where the counting integer, i, runs from 0 (zero) to the number of sampling points N in the 1D time-domain signal, $F_1(t)$. The normal sampling step, δt is corrected at each step of signal correction procedure. This will form a new, non-uniform time mesh $t_{new}$. Subsequently the 1D time-domain signal, $F_1(t_{new})$, may be interpolated, using these non-uniform time mesh points, onto a uniform time mesh again, for further use and analysis as desired. The quantity δt is the sampling interval described above with reference to FIG. 4. Effectively, this last operation shrinks/stretches time axis in the first dime dimension, $t_1$, so that the instantaneous time period, T, increases/reduces as appropriate, i.e. the time axis becomes non-uniform. T(t) may be interpolated or fitted with an analytical function in order to get individual $T(t_i)$ values, if required. Sometimes it is preferable to smooth the T(t) function before this time axis correction is performed. Interpolation, fitting and smoothing can be performed on the G(t) function alternatively.

An example of the 2D function, $F_2(t_1,t_2)$, when subject to the threshold condition, C, is shown in FIG. 9A. The G(t) function approximated by an analytical expression is shown by a dashed curve. The same data after correction is shown in FIG. 9B. The G(t) function used for this correction is shown by white curve, 60. This correction is especially useful when instability of the trapping field is caused by gate electrode pulse at the beginning of transient. Absorption mode (A-mode) of Fourier Transformation is substantially deteriorated in this case and cannot be used for mass spectra representation, because each peak will be inevitably accompanied by confusing side peaks. The correction method described above solves this problem for any frequency component. FIG. 10 shows an example of a Fourier Transform peak generated in A-mode of the signal presented in FIG. 9A. The A-mode Fourier Transform frequency peak generated from the un-corrected data is shown together with the A-mode Fourier Transform frequency peak generated from the corrected signal.

The method is especially efficient for non-harmonic signals which bear transient pulses having pulse widths/durations (cf. the interval of time, $\Delta t_1$) smaller compared to period of oscillations of a frequency component. Apart from its high resolution power, the method permits the dynamics of frequency components to be seen and analysed. Dynamics of the signal behaviour provided by the 2D function is useful for single ion analysis used in charge detection FTMS. Using the appropriate degree of averaging of time segments within the 2D function one can see single ion events including collision events occur during transient and resulting in collisional fragmentation. Furthermore, the fate of the ion can be seen, for example ion fragment and the change in ion kinetic energy even when this changes a little so that its frequency of oscillation changes only a little, or changes so much that the ion is subsequently unable to sustain oscillatory motion in the ion trap. It is important to detect these events as they will influence a Fourier Transform peak amplitude which might be used to gather statistics on single ion events to build an isotopic mass spectrum, and to determine a charge state of an ion.

For events in which frequency is changed only a little after collisional fragmentation, it is possible to gain information of what mass of the fragment is and it is possible to correct the instantaneous frequency so that it gives proper contribution into single ion event statistics.

EXAMPLE

As a brief example, applied to CDMS, once the correct period, $T_i$ of the periodic component has been identified within the image-charge/current signal generated by the oscillatory motion of an ion, as described above, one may then determine the charge on the ion as follows.

One may define a lifetime (LT) of an ion as a duration of time when the frequency of the periodic signal component associated with the ion is substantially constant. For example, a "channel" feature presented in the 2D function, $F_2(t_1, t_2)$, is present and linear (cf. FIG. 7B). One may average all of the data across all of the segments (i.e. the data summed and averaged over the second time dimension, $t_2$) that exist within this LT interval. This produces a single 1D curve, $S(t_1)$, in the first time dimension, $t_1$, alone since the second time dimension has been collapsed by the averaging process. This curve will represent an averaged time-domain peak induced by a single ion, e.g. a multiply-charged ion. The apex height/amplitude of a peak feature formed by the periodic component, gives the amount of charge on this ion.

A predetermined calibration curve may be used which relates a measured apex height/amplitude with ion charge. The apex height/amplitude may be determined by determining the maximal value of the 1D curve, $S(t_1)$, or may be more accurately determined e.g. fitting the 1D curve, $S(t_1)$, or at least the part of that curve containing the peak feature, to a Gaussian curve, a parabolic curve, or via an RC circuit signal fitting.

Alternatively, one may generate a 1D function, S(t), as an integrated or 'accumulated' signal in which discrete values of the 1D function $F_1(t)$, at sampling time points $t_i$, are each multiplied by the value of a pre-determined periodic function at the same respective sampling time points $t_i$. The resulting products are then summed. This maybe embodied as a scalar product, $F_1(t)\cdot G(t)$, of two vectors, $F_1(t)$ and G(t), as follows:

$$S(t)=\sum_{t_i=0}^{t} F_1(t_i)G(t_i)$$

Where, $$F_1(t)=[F_1(t_0), F_1(t_1), \ldots, F_1(t_i), \ldots, F_1(t)]^T$$

$$G(t)=[G(t_0), G(t_1), \ldots, G(t_i), \ldots, G(t)]^T$$

Figure 13A:
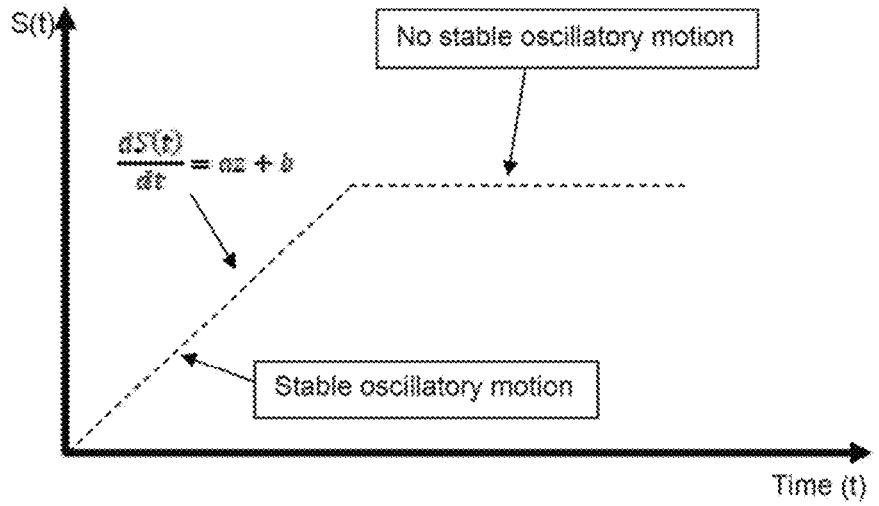
FIGS. 13A and 13B show a schematic representation of (A): an 'accumulated' function S(t); and, (B) periodic basis functions for use in the 'accumulated' function, in the form of a succession of equally-spaced Gaussian functions.
Figure 13B:
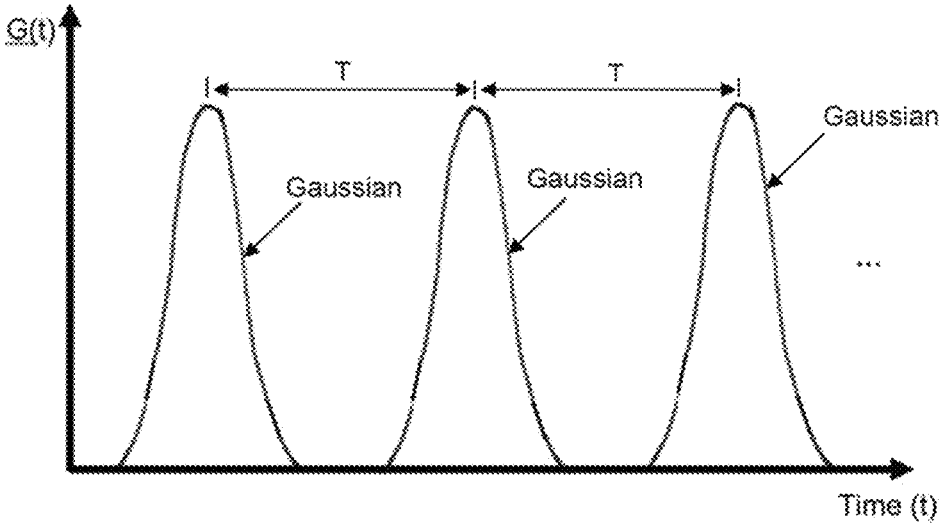

Here, $G(t_i)$ is the pre-determined periodic function with period of T, this being the period of the periodic component that has been identified within the image-charge/current signal generated by the oscillatory motion of an ion, as described above. The result is a function S(t) which is defined over the whole data acquisition time interval: t=[0; $T_{acq}$]. If the period, T, of the periodic component (signal frequency, f=1/T) remains constant, then the magnitude of the function, S(t), grows linearly with time (t) with a substantially constant rate of change (i.e. underlying 'slope' of rise). However, if the period of the periodic component changes (i.e. $T \rightarrow T^* \neq T$), then the rate of change (i.e. 'slope' of rise) of the magnitude of the function, S(t), also changes. This change in period occurs when the ion(s) responsible for generating the image-charge/current signal generated by the oscillatory motion, escapes from stable oscillatory motion. This growth and change in S(t) is schematically shown in FIG. 13A. Gaussian basis functions, as examples of $G(t_i)$, are schematically shown in FIG. 13B. These Gaussian basis functions collectively define the pre-determined periodic function in the sense that the Gaussian function repeats with a period of T. If the periodic function, $G(t_i)$, comprises sinusoidal basis functions (e.g. ~'sin' or ~'cos' function, or exponential basis functions, $\sim\exp(-i2\pi \cdot t/T)$), then it is not necessary to select an appropriate phase of the function—any phase is appropriate. However, for other forms of the periodic function, $G(t_i)$, (e.g. non-sinusoidal, such as Gaussian basis functions or delta-function basis functions) one may preferably select an appropriate phase of the periodicity within $G(t_i)$, for improved results. This phase preferably corresponds to the phase of the periodic components within their intervals [0;T]. In other words, the phase may preferably correspond to a time, $0 \leq t' \leq T$, within the very first segment [0;T], when an ion produces the very first signal pulse on the pick-up detector. As an example, if t'=T/3 then the phase of the periodic function, $G(t_i)$, may be selected so that the first Gaussian function, or delta function etc., is centred at the time t'=T/3 with all subsequent Gaussian function, or delta function etc., following at regular, periodic time intervals, T.

It is found that the rate of change of the magnitude of the function, S(t), (i.e. the slope of the growth of S(t)) within the data acquisition time interval: t=[0:$T_{acq}$], is proportional to the charge, z, of the ion:

$$\frac{dS(t)}{dt} = az + b$$

Here, the terms 'a' and 'b' are constants, predetermined calibration values. The charge, z, of the ion may be determined according to this equation.

REFERENCES

A number of publications are cited above in order to more fully describe and disclose the invention and the state of the art to which the invention pertains. Full citations for these references are provided below. The entirety of each of these references is incorporated herein.

WO02/103747 (A1) (Zajfman et al.)

U.S. Pat. No. 7,964,842 (B2) (Köster et al.)

WO2012/116765 (A1) (Ding et al)

"*High-Capacity Electrostatic Ion Trap with Mass Resolving Power Boosted by High-Order Harmonics*": by Li Ding and Aleksandr Rusinov, Anal. Chem. 2019, 91, 12, 7595-7602.

"*A Simulation Study of the Planar Electrostatic Ion Trap Mass Analyzer*": by Li Ding, Ranjan Badheka, Zhengtao Ding, and Hiroaki Nakanishi; J. *Am. Soc. Mass Spectrom.* 2013, 24, 3, 356-364.

WO2016/1083074A1 (Rusinov, et al.)

The invention claimed is:

1. A method of processing an image-charge/current signal representative of one or more ions undergoing oscillatory motion within an ion analyser apparatus, the method comprising:

obtaining a recording of the image-charge/current signal generated by the ion analyser apparatus in the time domain;

by a signal processing unit:

determining a value for the period of a periodic signal component within the recorded signal;

segmenting the recorded signal into a number of separate successive time segments of duration corresponding to the determined period;

co-registering the separate time segments in a first time dimension defining the determined period; and, separating the co-registered time segments along a second time dimension transverse to the first time dimension thereby to generate a stack of time segments collectively defining a 2-dimensional (2D) function which varies both across the stack in said first time dimension according to time within the determined period and along the stack in said second time dimension according to time between successive said time segments.

2. A method according to claim 1 comprising, on a display apparatus, plotting the 2D function on a plane comprising the first time dimension and the second time dimension and representing a fixed value of the function, or in 3-dimensional (3D) form further comprising third dimension transverse to said plane and representing variation in the function.

3. A method according to claim 1 comprising determining a change in said motion of an ion according to a corresponding change in the periodic signal component within the 2D function in the first time dimension and/or in the second time dimension.

4. A method according to claim 3 comprising determining, in the second dimension of time, a change in the position of said periodic signal component in the first dimension of time, thereby to identify a change in said oscillatory motion of an ion.

5. A method according to claim 3 comprising determining, in the second dimension of time, a change in the duration of said periodic signal component in the first dimension of time, thereby to identify a change in said oscillatory motion of an ion.

6. A method according to claim 3 comprising:

identifying, from amongst said separate successive time segments, time segments containing two or more periodic signal components in successive time segments; and, resolving two or more different mass-to-charge ratios (m/q) of said ions according to the two or more different periodic signal components within the 2D function.

7. A method according to claim 6 comprising determining a fragmentation of a said ion according to a bifurcation, in the second dimension of time, of the periodic signal component within the first dimension of time.

8. A method according to claim 3 comprising determining a time at which said change occurs, and applying a subsequent analytical process only to parts of the recorded signal generated before the time at which said change occurs.

9. A method according to claim 3 comprising determining a time at which said change occurs, and applying a subsequent analytical process only to parts of the recorded signal generated after the time at which said change occurs.

10. A method according to claim 3 comprising identifying, in the second dimension of time, a change in the position and/or duration of said periodic signal component in the first dimension of time, thereby to identify an instability in an electric field and/or magnetic field of said ion analyser apparatus.

11. A method according to claim 10 comprising correcting the 2D function based on the identified change to render said position of said periodic signal component in the first dimension of time, substantially unchanging in the second dimension of time.

12. A method according to claim 1 in which the signal processing unit is configured to determine said value for the period of a periodic signal component by iteratively:

segmenting the recorded signal into a number of separate successive time segments of duration corresponding to a trial period;

co-registering the separate time segments in said first time dimension defining the trial period;

separating the co-registered time segments along said second time dimension thereby to generate a said stack of time segments collectively defining a said 2-dimensional (2D) function; and, determining whether the position of the periodic component in the first time dimension changes along the second time dimension, the iterative process ending when it is determined that substantially no such change occurs.

13. A method according to claim 1 including:

determining a sub-set of instances of the 2D function in which the value of the 2D function falls below a pre-set threshold value;

from amongst said sub-set of instances, and within each separate time segment, determining an interval of time in the first time dimension during which the 2D function never falls below said pre-set threshold value; and, identifying the interval of time as the periodic signal component.

14. A method according to claim 13 comprising determining in the second dimension of time, a change in the duration of said interval of time in the first dimension of time, thereby to identify a change in said oscillatory motion of an ion.

15. A method according to claim 13 comprising determining in the second dimension of time, a change in the position of said interval of time in the first dimension of time, thereby to identify a change in said oscillatory motion of an ion.

16. A method according to claim 1 comprising identifying, from amongst said separate successive time segments, time segments containing multiple periodic signal components which occur between time segments containing only one periodic signal component, and excluding those identified segments from the stack, thereby leaving within the stack those time segments containing only one periodic signal component.

17. A method according to claim 1 wherein the step of obtaining a recording of the image-charge/current signal generated by the ion analyser apparatus in the time domain includes obtaining a plurality of image charge/current signals before processing the plurality of image charge/current signals by said signal processing unit, wherein obtaining the plurality of image charge/current signals includes:

producing ions;

trapping the ions such that the trapped ions undergo oscillatory motion; and obtaining a plurality of image charge/current signals representative of the trapped ions undergoing oscillatory motion using at least one image charge/current detector.

18. An ion analyser apparatus configured to generate an image charge/current signal representative of one or more ions undergoing oscillatory motion therein, wherein the ion analyser apparatus is configured to implement the method according to claim 1.

19. An ion analyser apparatus according to claim 18 comprising any one or more of: an ion cyclotron resonance trap; an Orbitrap® configured to use a hyper-logarithmic electric field for ion trapping; an electrostatic linear ion trap (ELIT); a quadrupole ion trap; an ion mobility analyser; a charge detection mass spectrometer (CDMS); Electrostatic Ion Beam Trap (EIBT); a Planar Orbital Frequency Analyser (POFA); or a Planar Electrostatic Ion Trap (PEIT), for generating said oscillatory motion therein.

20. An ion analyser apparatus configured for generating an image-charge/current signal representative of oscillatory motion of one or more ions received therein, the apparatus comprising:

an ion analysis chamber configured for receiving said one or more ions and for generating said image charge/current signal in response to said oscillatory motion;

a signal recording unit configured for recording the image charge/current signal as a recorded signal in the time domain;

a signal processing unit for processing the recorded signal to:

determine a value for the period of a periodic signal component within the recorded signal;

segment the recorded signal into a number of separate successive time segments of duration corresponding to the determined period;

co-register the separate time segments in a first time dimension defining the determined period; and, separate the co-registered time segments along a second time dimension transverse to the first time dimension thereby to generate a stack of time segments collectively defining a 2-dimensional (2D) function which varies both across the stack in said first time dimension according to time within the determined period and along the stack in said second time dimension according to time between successive said time segments.

21. An ion analyser apparatus according to claim 20 wherein the ion analyser apparatus is configured for producing ions, and the ion analysis chamber is configured for;

trapping the ions such that the trapped ions undergo oscillatory motion; and obtaining a plurality of image charge/current signals representative of the trapped ions undergoing oscillatory motion using at least one image charge/current detector.

22. An ion analyser apparatus according to claim 20 comprising any one or more of: an ion cyclotron resonance trap; an Orbitrap® configured to use a hyper-logarithmic electric field for ion trapping; an electrostatic linear ion trap (ELIT); a quadrupole ion trap; an ion mobility analyser; a charge detection mass spectrometer (CDMS); Electrostatic Ion Beam Trap (EIBT); a Planar Orbital Frequency Analyser (POFA); or a Planar Electrostatic Ion Trap (PEIT), for generating said oscillatory motion therein.

23. A computer-readable medium having computer-executable instructions configured to cause a mass spectrometry apparatus to perform a method of processing a plurality of image charge/current signals representative of trapped ions undergoing oscillatory motion, the method being according to claim 1.

* * * * *